US005597334A

United States Patent [19]

Ogino

[11] Patent Number: 5,597,334

[45] Date of Patent: Jan. 28, 1997

[54] OUTBOARD DRIVE TRANSMISSION SYSTEM

[75] Inventor: Hiroshi Ogino, Hamamatsu, Japan

[73] Assignee: Sanshin Kogyo Kabushiki Kaisha, Shizuoka, Japan

[21] Appl. No.: 465,247

[22] Filed: Jun. 5, 1995

Related U.S. Application Data

[63] Continuation-in-part of Ser. No. 346,397, Nov. 29, 1994, and a continuation-in-part of Ser. No. 346,383, Nov. 29, 1994, Pat. No. 5,514,014.

[30] Foreign Application Priority Data

| | | | |
|---|---|---|---|
| Nov. 29, 1993 | [JP] | Japan | 5-298250 |
| Nov. 29, 1993 | [JP] | Japan | 5-298656 |
| Jun. 30, 1994 | [JP] | Japan | 6-149451 |

[51] Int. Cl.[6] ..... B63H 21/28

[52] U.S. Cl. ..... 440/75; 184/6.12

[58] Field of Search ..... 440/75, 78, 83, 440/86, 900; 184/6.12; 192/21, 51; 74/378

[56] References Cited

U.S. PATENT DOCUMENTS

| | | |
|---|---|---|
| 537,612 | 4/1895 | Leathers . |
| 599,125 | 2/1898 | Fefel . |
| 624,674 | 5/1899 | Painton . |
| 938,911 | 11/1909 | Taylor . |
| 1,807,254 | 5/1931 | Piano . |
| 1,813,552 | 7/1931 | Stechauner . |
| 1,853,694 | 4/1932 | Melcher . |
| 2,058,361 | 10/1936 | Sherwood . |
| 2,064,195 | 12/1936 | De Michelis . |
| 2,347,906 | 5/1944 | Hatcher . |
| 2,372,247 | 3/1945 | Billing . |
| 2,672,115 | 3/1954 | Conover . |
| 2,987,031 | 6/1961 | Odden . |
| 2,989,022 | 6/1961 | Lundquist . |
| 3,478,620 | 11/1969 | Shimanckas . |
| 3,769,930 | 11/1973 | Pinkerton . |
| 4,529,387 | 7/1985 | Brandt . |
| 4,540,369 | 9/1985 | Caires . |
| 4,619,584 | 10/1986 | Brandt . |
| 4,642,059 | 2/1987 | Nohara . |
| 4,741,670 | 5/1988 | Brandt . |
| 4,767,269 | 8/1988 | Brandt . |
| 4,790,782 | 12/1988 | McCormick . |
| 4,792,314 | 12/1988 | McCormick . |
| 4,793,773 | 12/1988 | Kinouchi et al. . |
| 4,795,382 | 1/1989 | McCormick . |
| 4,828,518 | 5/1989 | Kouda et al. . |
| 4,832,570 | 5/1989 | Solia . |
| 4,832,636 | 5/1989 | McCormick . |
| 4,840,136 | 6/1989 | Brandt . |
| 4,887,982 | 12/1989 | Newman et al. . |
| 4,887,983 | 12/1989 | Bankstahl et al. . |
| 4,897,058 | 1/1990 | McCormick . |
| 4,932,907 | 6/1990 | Newman et al. . |
| 4,963,108 | 10/1990 | Koda et al. . |
| 4,993,848 | 2/1991 | John et al. . |
| 5,009,621 | 4/1991 | Bankstahl et al. . |
| 5,017,168 | 5/1991 | Ackley . |
| 5,030,149 | 7/1991 | Fujita . |
| 5,186,609 | 2/1993 | Inoue et al. . |
| 5,230,644 | 7/1993 | Meisenburg et al. . |
| 5,232,386 | 8/1993 | Gifford . |
| 5,249,995 | 10/1993 | Meisenburg et al. . |
| 5,342,228 | 8/1994 | Magee et al. . |
| 5,344,349 | 9/1994 | Meisenburg et al. . |
| 5,352,141 | 10/1994 | Shields et al. . |
| 5,366,398 | 11/1994 | Meisenburg et al. . |

*Primary Examiner*—Jesus D. Sotelo

*Attorney, Agent, or Firm*—Knobbe, Martens, Olson & Bear, LLP

[57] ABSTRACT

A transmission for a counter-rotational propeller system of a watercraft outboard drive includes an improved clutch coupling which allows relative motion between a clutch and a portion of a clutch actuator, while reducing friction and wear between these components. The coupling includes an annular collar that is captured within an inner bore of the clutch. The ends of the collar are journaled within the bore for relative rotation between the collar and the clutch. Sufficient spacing also is maintained between the collar outer periphery and the inner bore wall to prevent contact between the collar and the clutch. A pin connects the collar to the clutch actuator.

38 Claims, 9 Drawing Sheets

OUTBOARD DRIVE TRANSMISSION SYSTEM

RELATED CASES

The present application is a continuation-in-part of copending U.S. application Ser. No. 08/346,397, filed on Nov. 29, 1994, and a continuation-in-part of U.S. application Ser. No. 08/346,383, filed on Nov. 29, 1994, now U.S. Pat. No. 5,514,014. U.S. application Ser. Nos. 08/346,397 and 08/346,383 are hereby incorporated by reference. In addition, the present application and the parent applications each claim foreign priority from Japanese Patent Application Ser. Nos. Hei 6-149451, Hei 5-298656, and Hei 5-298250, respectively.

BACKGROUND OF THE INVENTION

1. Field of the Invention

The present invention relates in general to a marine propulsion system, and in particular to a transmission for a propulsion system of an outboard drive.

2. Description of Related Art

Many outboard drives of marine watercrafts employ a counter-rotating propeller system operated by a forward-neutral-reverse transmissions. Such propulsion systems are used in both outboard motors and in stern drive units of inboard/outboard motors.

These transmissions typically include a driving pinion and a pair of oppositely rotating driven bevel gears. A front dog clutch of a dual clutch assembly is interposed between the pair of oppositely rotating gears. The clutch drives a inner propulsion shaft through a spline connection. The inner propulsion shaft in turn drives a rear propeller.

The transmission also includes a second dog clutch that is positioned on the rear side of the rear driven gear. The rear clutch selectively engages corresponding teeth formed on a hub of the rear gear to drive an outer propeller shaft. The outer propulsion shaft in turn drives a front propeller.

An actuator mechanism selectively moves the clutches into engagement with the driven gears. A front pin, which extends transversely to the axis of the inner shaft, directly connects the front dog clutch to a plunger of the actuator mechanism. A rear pin, which also extends transversely to the inner shaft axis, couples the rear clutch to the plunger. The ends of the rear pin extend into an annular groove formed within the rear gear body and are captured within the groove. During at least one drive condition (e.g., a forward drive condition), the rear pin and the rear clutch rotate in opposite directions at high rotational speeds.

Although this prior coupling design between the plunger and the rear clutch allows the plunger to move the clutch while permitting the rear clutch to rotate relative to the plunger and rear pin, the prior coupling design tends to produce significant friction and wear between the rear pin and the rear clutch. Prior attempts the journal the pin ends within the annular groove also have proven less than adequate in reducing friction and wear between these components.

SUMMARY OF THE INVENTION

A need therefore exists for an improved coupling between an actuator and a clutch which minimizes frictional contact between the actuator and the clutch while effectively coupling the components together in order for the actuator to operate the clutch.

In accordance with one aspect of the present invention, a transmission for a marine outboard drive comprises a first driven gear and a corresponding first clutch. The first clutch is coupled to a first propulsion shaft and is arranged to selectively couple the first propulsion shaft to the first driven gear when actuated by an actuator. The actuator is connected to an annular member. The annular member is journaled within the first clutch in a manner permitting the first clutch to rotate relative to the annular member.

Another aspect of the present invention involves a transmission for a marine outboard drive. The transmission comprises a first driven gear and a corresponding first clutch. The first clutch is coupled to a first propulsion shaft and is arranged to selectively couple the first propulsion shaft to the first driven gear when actuated by an actuator. A coupling mechanism couples the first clutch to the actuator in a manner permitting the first clutch to rotate relative to the actuator. The coupling mechanism includes a pin which extends within the first clutch in a direction generally transverse to an axis of the first propulsion shaft. The pin is connected to the actuator. A collar of the coupling mechanism is held within the first clutch. The collar captures at least a portion of the pin such that the collar rotates with the actuator.

BRIEF DESCRIPTION OF THE DRAWING

These and other features of the invention will now be described with reference to the drawings of preferred embodiments which are intended to illustrate and not to limit the invention, and in which.

DETAILED DESCRIPTION OF PREFERRED EMBODIMENTS

Figure 1:
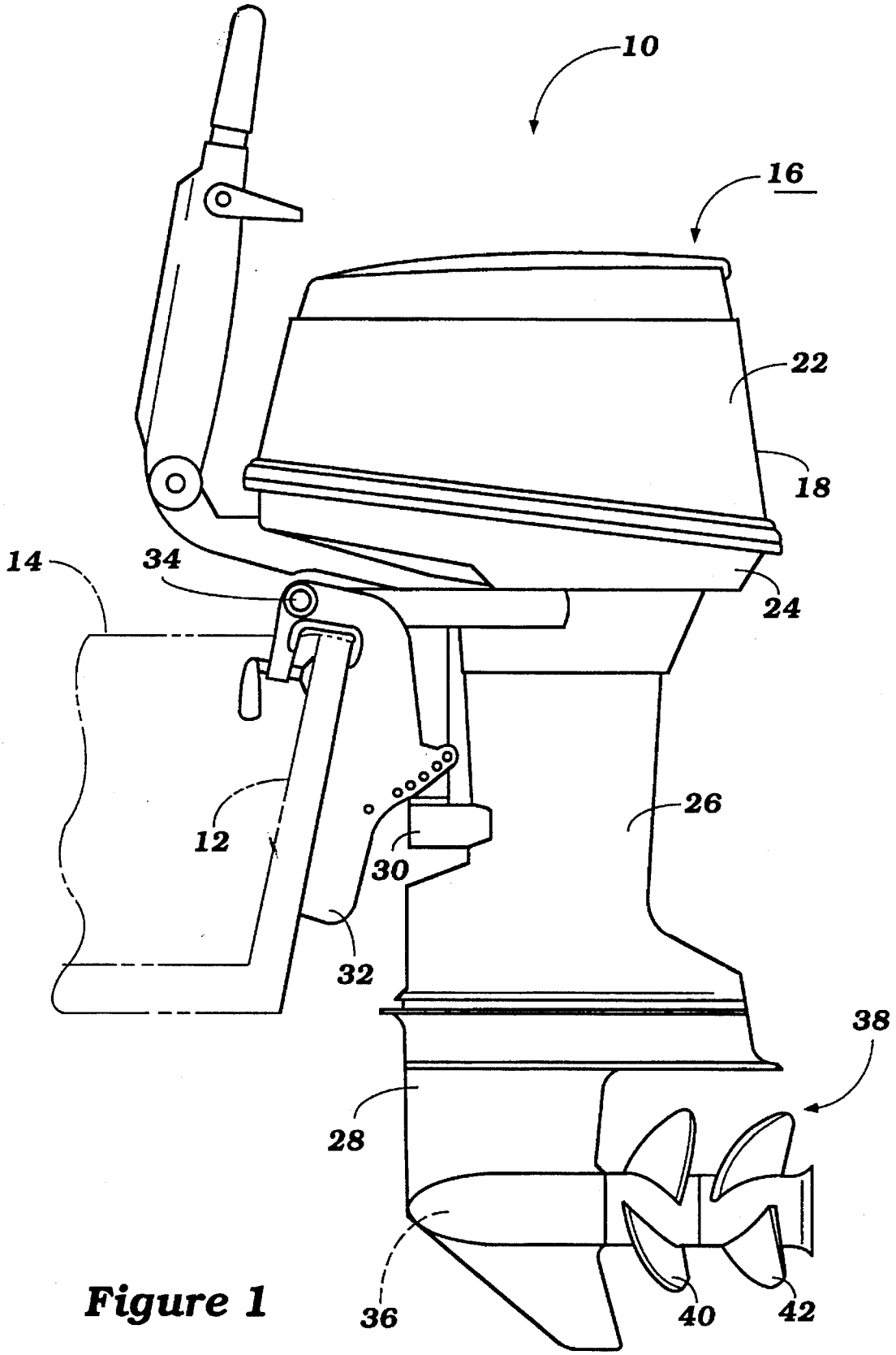
FIG. 1 is a side elevational view of a marine outboard motor configured in accordance with a preferred embodiment of the present invention.

FIG. 1 illustrates a marine outboard drive 10 configured in accordance with a preferred embodiment of the present invention. In the illustrated embodiment, the outboard drive 10 is depicted as an outboard motor for mounting on a transom 12 of a watercraft 14. It is contemplated, however, that those skilled in the art will readily appreciate that the present invention can be applied to stern drive units of inboard-outboard motors and to other types of watercraft drive units as well.

In the illustrated embodiment, the outboard drive 10 has a power head 16 which includes an engine (not shown). A conventional cowling 18 surround the engine. The cowling 18 desirably includes a lower tray 20 and a top cowling member 22. These components 20, 22 of the protective cowling 18 together define an engine compartment which houses the engine.

The engine is mounted conventionally with its outward shaft (i.e., a crankshaft) rotating about a generally vertical axis. The crankshaft (not shown) drives a drive shaft 24 (FIG. 2), as known in the art. The drive shaft 24 depends from the power head 16 of the outboard drive 10.

A drive shaft housing 26 extends downward from the lower tray 20 and terminates in a lower unit 28. The drive shaft 24 extends through and is journaled within the drive shaft housing 26 in a conventional manner.

The engine includes an exhaust system which discharges exhaust gases through an exhaust pipe (not shown). The exhaust depends from the engine, which is positioned within the cowling 18, into an exhaust expansion chamber (not shown) formed in the drive shaft housing 26.

A steering bracket 30 is attached to the drive shaft housing 26 in a known manner. The steering bracket 30 also is pivotally connected to a clamping bracket 32 by a pin 34. The clamping bracket 32, in turn, is configured to attach to the transom 12 of the watercraft 14. This conventional coupling permits the outboard drive 10 to be pivoted relative to the steering bracket 30 for steering purposes, as well as to be pivoted relative to the pin 34 to permit adjustment to the trim position of the outboard drive and for tilt up of the outboard drive 10. Although not illustrated, it is understood that a conventional hydraulic tilt and trim cylinder assembly, as well as a conventional hydraulic steering cylinder assembly could be used as well with the present outboard drive 10.

The lower unit 28 houses a transmission 36 which selectively establishes a driving condition of a propulsion device 38, such as, for example, a propeller, a hydrodynamic jet, or the like. The transmission 36 advantageously is a forward-neutral-reverse-type transmission. In this manner, the propulsion device 38 can drive the watercraft in any of these three operating states.

The present transmission is particularly well suited for use with a counter-rotational propulsion device 38. In the illustrated embodiment, the propulsion device 38 is a counter-rotational propeller device that includes a first propeller 40 designed to spin in one direction and to assert a forward thrust, and a second propeller 42 designed to spin in an opposite direction and to assert a forward thrust. Because the pitch of the propeller blades are of the opposite hand, the oppositely spinning blades of the propellers 40, 42 both assert a forward driving thrust when driven under a forward drive condition. Under a reverse drive condition, the transmission desirably drives only one of the propellers 40, 42, as described below; however, the transmission 36 can be configured alternatively to drive both propellers 40, 42 under a reverse drive condition.

Figure 2:
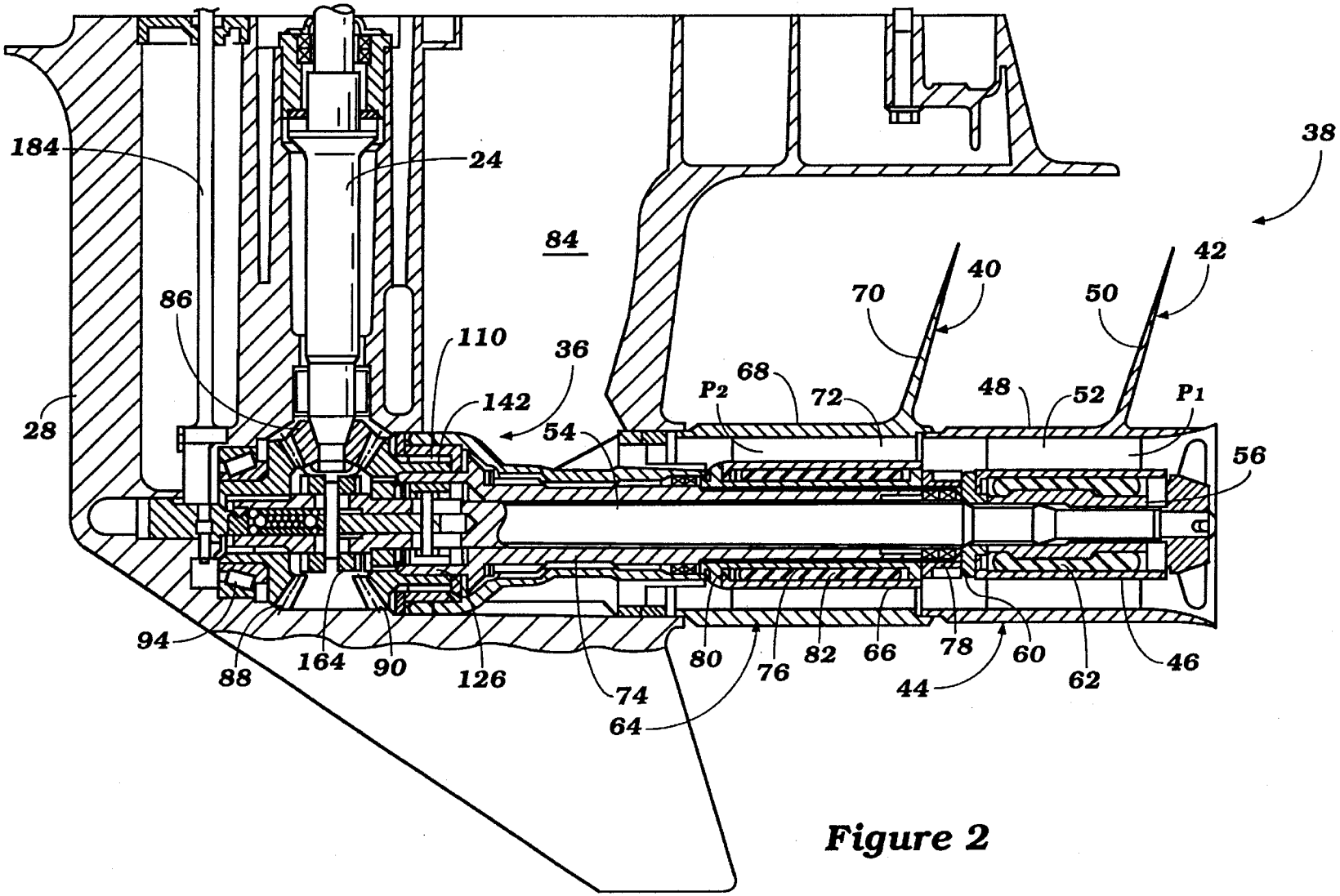
FIG. 2 is a sectional side elevational view of a lower unit of the marine outboard motor of FIG. 1.

FIG. 2 illustrates the components of the front and rear propellers 40, 42. The rear propeller 42 includes a boss 44 formed in part by an inner sleeve 46 and an outer sleeve 48 to which the propeller blades 50 are integrally formed. A plurality of radial ribs 52 extend between the inner sleeve 46 and the outer sleeve 48 to support the outer sleeve 48 about the inner sleeve 46 and to form a passage $P_1$ through the propeller boss 44. Engine exhaust is discharged through the passage $P_1$, as known in the art.

An inner propulsion shaft 54 drives the rear propeller boss 44. For this purpose, the rear end of the inner propulsion shaft 54 carries an engagement sleeve 56 which has a spline connection with the rear end of the rear propulsion shaft 54. The sleeve 56 is fixed to the rear end of the inner shaft 54 between a nut 58 threaded on the rear end of the shaft 54 and a rear thrust washer 60 positioned between the front and rear propeller 40, 42.

An elastic bushing 62 is interposed between the engagement sleeve 56 and the rear propeller boss 44 and is compressed therebetween. The bushing 62 is secured to the engagement sleeve 56 by a heat process known in the art.

The frictional engagement between the boss 44 and the elastic bushing 62 is sufficient to transmit rotational forces from the engagement sleeve 56, driven by the inner propulsion shaft 54 to the rear propeller blades 50. The bushing 62 provides vibrational damping between the drive shaft 54 and the propeller hub 44.

The front propeller 40 likewise includes a front propeller boss 64. The front propeller boss 64 has an inner sleeve 66 and an outer sleeve 68. Propeller blades 70 of the front propeller 64 are integrally formed on the exterior of the outer sleeve 68. Ribs 72 connect the inner sleeve 66 and the outer sleeve 68 to form an axially extending passage $P_2$ between the sleeves 66, 68. The passage $P_2$ communicates with the passage $P_1$ of the rear propeller boss 44 so as to form a continuous exhaust discharge passage through the propulsion device 38.

An outer propulsion shaft 74 carries the front propeller 40. As best seen in FIG. 2, the rear end portion of the outer propulsion shaft 74 carries a front engagement sleeve 76 and drives the engagement sleeve 76 thereabouts by a spline connection. The front engagement sleeve 76 is secured onto the outer propulsion shaft between an annular retaining ring 78 and a front thrust valve 80.

A front annular elastic bushing 82 surrounds the front engagement sleeve 76. The bushing 82 is secured to the sleeve 76 by a heat process known in the art.

The front propeller boss 64 surrounds the elastic bushing 82, which is held under pressure between the boss 64 and the engagement sleeve 76 in frictional engagement. The frictional engagement between the propeller boss 64 and the bushing 82 is sufficient to transmit a rotational force from the sleeve 76 to the propeller blades 70 of the front propeller boss 64. Again, the elastic bushing 82 affords vibrational damping between the drive shaft 74 and the propeller boss 64.

As understood from FIG. 2, the drive shaft housing 26 and the lower unit 28 together define an exhaust discharge duct 84 which delivers engine exhaust from the expansion chamber of the drive shaft housing 26 to the exhaust discharge passages $P_1$ and $P_2$ formed within the propulsion device 38, as known in the art. The outlet end of the exhaust discharge passage $P_1$ and $P_2$ is located behind the propulsion device 38.

The individual components of the present transmission 36 will now be described in detail with reference to FIGS. 2–6. Additionally, in connection with the description of the components, "front" and "rear" are used herein in reference to the bow of the watercraft 14.

With reference to FIG. 2, the drive shaft 24 carries a drive gear or pinion 86 at its lower end, which is disposed within the lower unit 28 and which forms a portion of the transmission 36. The drive gear 86 preferably is a bevel type gear.

The transmission 36 also includes a pair of counter-rotating driven gears 88, 90 that are in mesh engagement with the drive gear 86. The pair of driven gears 88, 90 preferably are positioned on diametrically opposite sides of the drive gear 86, and are suitably journaled within the lower unit 28 as described below. Each driven gear 88, 90 is positioned at about a 90° shaft angle with the drive gear 86. That is, the propulsion shafts 54, 74 and the drive shaft 24 desirably intersect at about a 90° shaft angle; however, it is contemplated that the drive shaft 24 and the propulsion shaft 54, 74 can intersect at almost any angle.

Figure 3:
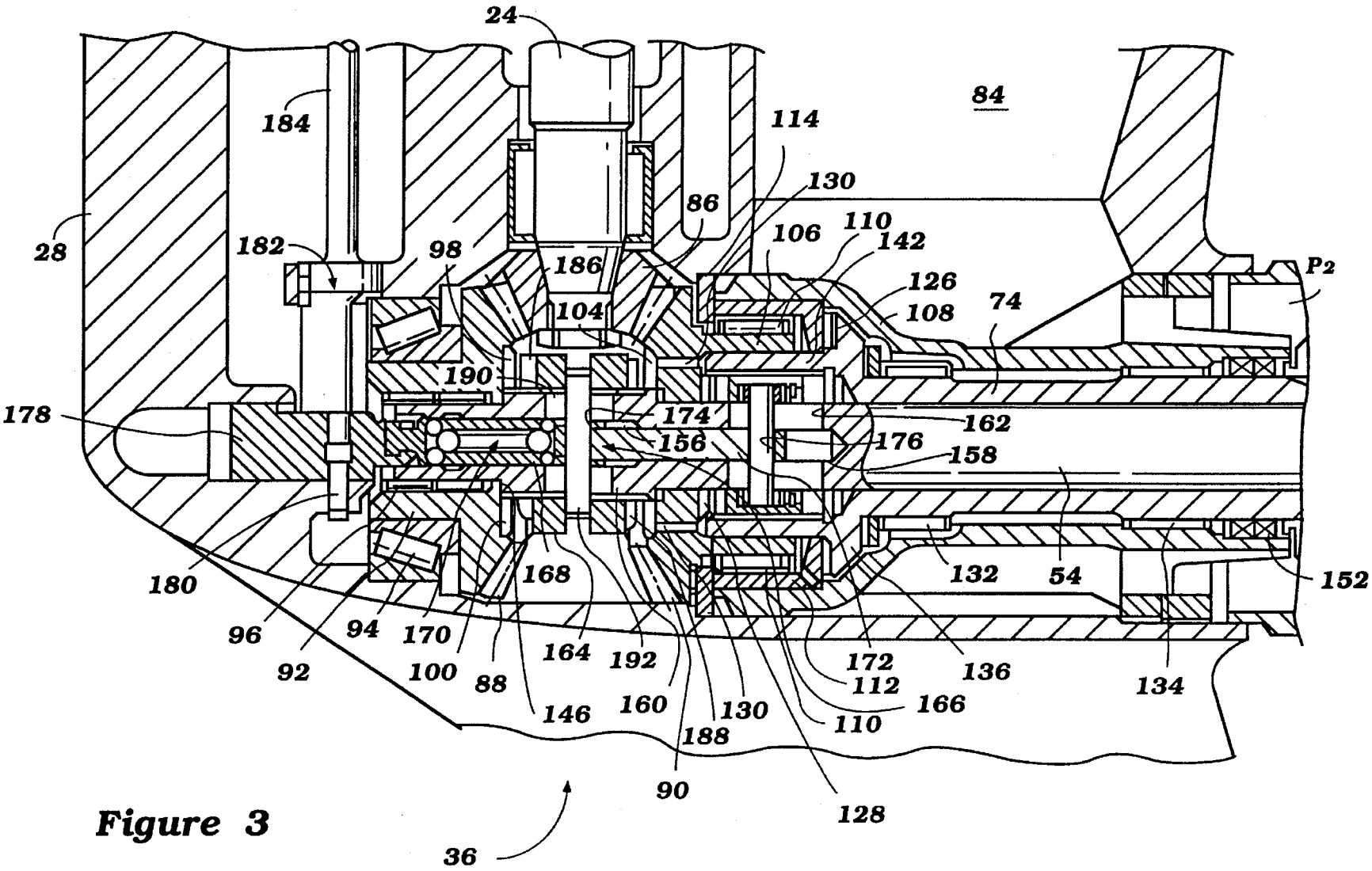
FIG. 3 is an enlarged sectional side elevational view of a transmission of the lower unit of FIG. 2.

In the illustrated embodiment, the pair of driven gears 88, 90 are a front bevel gear 88 and an opposing rear bevel gear 90. As best seen in FIG. 3, the front bevel gear 88 includes a hub 92 which is journaled within the lower unit 28 by front thrust bearing 94. The thrust bearing 94 rotatably supports the front gear 88 in mesh engagement with the drive gear 86.

Figure 4:
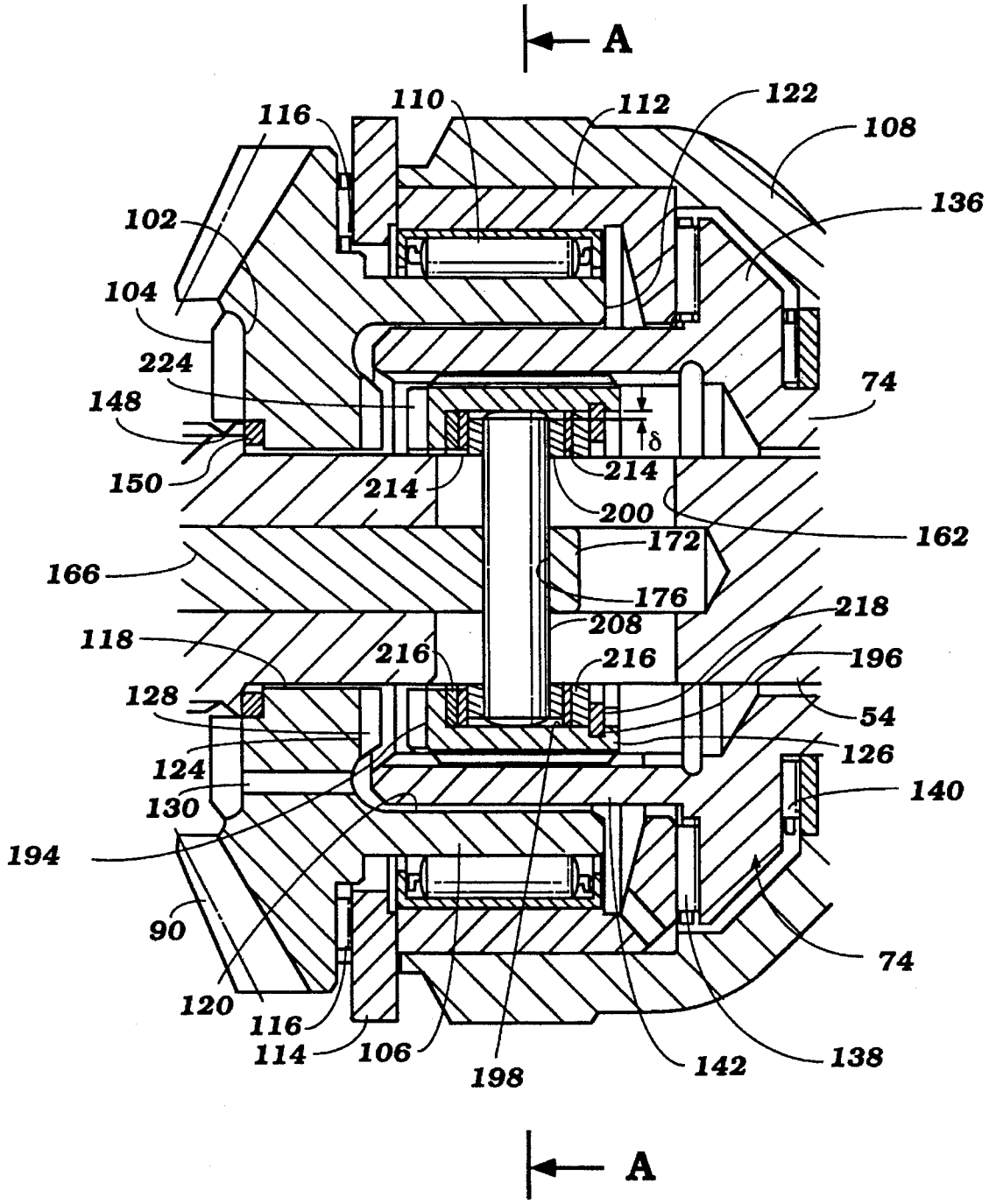
FIG. 4 is an enlarged sectional side elevational view of a rear clutch and thrust bearing assembly of the transmission of FIG. 3.

As best seen in FIG. 4, the hub 92 has a central bore through which the inner propulsion shaft 54 passes when assembled. A needle bearing assembly 96 journals the inner propulsion shaft 54 within the central bore of the front gear hub 92. As seen in FIG. 3, the inner propulsion shaft 54 includes a step diameter section to receive the needle bearing assembly 96 in this location.

The front gear 88 also includes a series of teeth 98 formed on an annular rear facing engagement surface 100. The teeth 98 positively engage a clutch of the transmission 36, as described below.

As seen in FIG. 3, the inner drive shaft 54 contacts the engagement surface 100 of the front gear at the step diameter section of the shaft 54 proximate to the needle bearing assembly 96. In this manner, forward thrust from the shaft 54 is transferred to the front gear 88 and to the thrust bearings 94 supported by the lower unit 28.

As best seen in FIG. 4, the rear gear 90 also includes an annular front engagement surface 102 which carries a series of clutching teeth 104. The teeth 104 are configured to positively engage the clutch of the transmission 36, as described below.

The rear gear 90 includes a bearing hub 106 which is suitable journaled within a bearing carrier 108 of the lower unit 28 by a needle bearing assembly 110. The needle bearing assembly 110 includes an outer cage 112 that is received and retained within an enlarged forward portion of the bearing carrier 108 by a retainer ring 114. A thrust bearing assembly 116 is interposed between the rear gear 90 and the retainer ring 114 to take the thrust loading on the rear gear 90.

The bearing hub 106 of the rear gear 90 advantageously has a hollow shape with a stepped diameter formed by an inner bore 118 and a counterbore 120. The inner bore 118 extends entirely through the gear 90 from the front engagement surface 102 to a rear end 122 of the hub 106. The inner bore 118 has a sufficiently sized diameter to receive the inner propulsion shaft 54 when assembled.

The counterbore 120 extends into the hub from its rear end 122 and terminates at a rear engagement surface 124 defined within the hollow bearing hub 106. The counterbore 120 has a sufficiently sized diameter to receive an end of the outer propulsion shaft 74 and a substantial portion of a rear clutch 126, described below. As used herein, "a substantial portion" of the clutch 126 means at least a portion of the clutch sleeve in addition to the clutching element (e.g., teeth, comb, etc.).

The rear engagement surface 124 of the rear gear hub 106 desirably lies parallel to the front engagement surface 102 and generally perpendicular to the axis of the inner bore 118. The rear engagement surface 124 carries a series of clutching teeth 128 which engage a portion of the rear clutch 126, as discussed below.

As seen in FIG. 4, the rear gear 90 also includes a plurality of lubricant passages 130 that extend through the gear between the front and rear engagement surfaces 102, 124. These passages 130 allow lubricant flow from a main lubricant sump between the driven gears 88, 90 into the counterbore 120 in which the rear clutch 126 operates, as described below.

As best seen in FIG. 3, the inner propulsion shaft 54 and the hollow outer propulsion shaft 74 extend from the transmission 36 through the bearing carrier 108. The bearing carrier 108 rotatably supports the outer propulsion shaft 74, with the inner propulsion shaft 54 journaled within the outer propulsion shaft 74, as described below. A front needle bearing assembly 132 journals a front end of the outer propulsion shaft 74 within the bearing carrier 108. And a rear needle bearing assembly 134 supports the outer propulsion shaft 74 an an opposite end of the bearing cover from the front needle bearing assembly 132.

The outer propulsion shaft 74 also includes an integrally formed thrust flange 136 located forward of the front needle bearing assembly 132. As best seen in FIG. 4, the thrust flange 136 has a forward facing thrust surface that engages a thrust bearing assembly 138 so as to transfer the forward driving thrust from the front propeller 40 through the thrust bearing 138, outer cage 112 and retainer ring 114 to the lower unit housing 28.

Rearward driving thrusts are transmitted to the bearing carrier 108 and lower unit housing 28 from the rear facing thrust shoulder of the thrust flange 136. The rearward facing thrust shoulder of the thrust flange 136 engages a needle-type thrust bearing assembly 140 having a face that is engaged with a shoulder with the bearing carrier 108. Because the thrust flange 136 and the bearing assemblies 138, 140, which journal the thrust flange 136 within the bearing carrier 108, form no significant part of the invention, further description of these elements is not believed necessary for an understanding of the present transmission 36.

As been seen in FIG. 4, the outer propulsion shaft 74 includes an integrally formed front rim 142 that extends from the thrust flange 136 in the forward direction. The front rim 142 has an outer diameter which is slightly smaller than the diameter of the counterbore 120 of the rear gear hub 106 so as to fit within the counterbore 120 of the rear gear hub 106. The front rim 142 also has an inner diameter which is sized to receive the rear clutch 126, as discussed below.

With reference to FIG. 3, the inner propulsion shaft 54, as noted above, extends through the front gear hub 92 where the needle bearing assembly 96 journals the front end of the propulsion shaft 54 within the front gear 88. The inner propulsion shaft 54 also extends through the rear gear hub 106 and through the hollow outer propulsion shaft 74. As seen in FIG. 2, a needle bearing assembly 144 journals and supports the inner propulsion shaft 54 at the rear end of the outer propulsion shaft 74. The inner propulsion shaft 54 projects beyond the rear end of the outer propulsion shaft 74 to support the real propeller 42.

With reference to FIG. 3, the inner propulsion shaft 54 includes a section having an increased diameter which is positioned between the front and rear gears 88, 90. The transition between the reduced diameter section at the front end of the inner propulsion shaft 54, which is supported by the needle bearing assembly 96, and the large diameter section of the inner propulsion shaft 54 between the gears 88, 90, forms a front step 146. Likewise, the transition between the large diameter section of the inner propulsion shaft 54 between the gears 88, 90 and the portion of the inner propulsion shaft 54 which extends through the outer propulsion shaft 74 forms a second step 148. As best seen in FIG. 4, an annular elastic bushing 150 is positioned between the front engagement surface 102 of the rear gear 90 and the step 148. Specifically, the front engagement surface 102 of the rear gear 90 includes an annular seat which circumscribes the inner bore 118 of the rear gear 90 and forms a seat for the elastic bushing 150. As understood from FIGS. 3 and 4, the elastic bushing 150 biases the inner propulsion forward such that the front step 146 of the inner propulsion shaft 54 abuts the front engagement surface 100 of the front gear 90, as shown in FIG. 3. In this manner, forward driving thrust gets transferred from the inner propulsion shaft 54 to the front gear 88. The front thrust bearings 94 thus take the forward driving thrust from the front gear 88 so as to transfer this loading to the lower unit 28. Under a reverse driving condition, the rearward thrust causes the step 148 of the inner propulsion shaft 54 to compress the elastic bushing 150. As a result, the front step 146 of the inner propulsion shaft 54 moves slightly away from the front engagement surface 100 of the front gear 88 to inhibit frictional contact between the inner propulsion shaft and the front gear 88 which rotate in opposite directions under a reverse drive condition.

The rear thrust is transferred from the inner propulsion shaft 54 to the rear gear 90 through the elastic bushing 150. The needle bearing assembly 116 takes the rear thrust loading from the rear gear 90 and transfers it to the retainer ring 114.

With reference to FIG. 3, a front pair of seals 152 (e.g., oil seals) are interposed between the bearing carrier 108 and the outer propulsion shaft 74 at the rear end of the bearing carrier 108. Likewise, a second pair of seals 154 (e.g., oil seals) are interposed between the inner propulsion shaft 54 and the outer propulsion shaft 74 at the rear end of the outer shaft 74. Lubrication within the lubrication sump flows through the gaps between the bearing carrier 108 and the outer shaft 74, and between the outer shaft 74 and the inner shaft 54, to lubricate the bearings 134, 144 supporting the inner propulsion shaft 54 and the outer propulsion shaft 74. The seals 152, 154 which are located at the rear end of the bearing carrier 108 and the outer shaft 74, substantially prevent lubricant flow beyond these points.

The front end of the inner propulsion shaft 54 includes a longitudinal bore with a step diameter formed by a first section 156 and a smaller diameter second section 158. The first section 156 of the bore stems from the front end of the inner propulsion shaft 54 to a transition surface which is positioned on the rear side of the axis of the drive shaft 24. The second section 158 of the bore stems from the transition surface to a point that generally coincides in the axial direction with the position of the thrust flange 136 of the outer propulsion shaft 74 when assembled.

As seen in FIG. 3, a front aperture 160 extends through the inner propulsion shaft 54, transverse to the axis of the longitudinal bore at a generally symmetrical position between the driven gears 88, 90. The inner propulsion shaft 54 also includes a rear aperture 162 that extends transverse to the axis of the longitudinal bore at a position within the hollow bearing hub 106 of the rear gear 90.

As best seen in FIG. 3, the transmission 36 also includes a front clutch 164 and the rear clutch 126 coupled to a plunger, generally designated as 166. As described below in detail, the front clutch 164 selectively couples the inner propulsion shaft either to the front gear 88 or to the rear gear 90. The rear clutch 126 selectively couples the outer propulsion shaft to the rear gear 90. FIG. 3 illustrates the front clutch 164 and the rear clutch 126 set in a neutral position (i.e., in a position in which the clutches 164, 126 do not engage either the front gear 88 or the rear gear 90). In the illustrated embodiment, the clutches 164, 126 are positive-contact clutches, such as, for example, dog clutches; however, it is contemplated that the present transmission could be designed with friction-type clutches.

The plunger 166 has a generally cylindrical rod shape and slides within the longitudinal bore of the inner propulsion shaft 54 to actuate the clutches 164, 126. In the illustrated embodiment, the plunger 166 comprises a hollow first segment 168 which houses a neutral detent mechanism 170. The detent mechanism 170 will be described below. The plunger 166 also includes a solid second segment 172. The plunger first segment 168 is sized to slide within the first section 156 of the longitudinal bore at the front end of the propulsion shaft 54. The plunger second segment 172 is sized to slide within the second section 158 of the longitudinal bore of the inner propulsion shaft 54. The second segment 172 also is sized to fit inside the first segment 168.

The plunger segments 168, 172 together define a front hole 174 that is positioned generally transverse to the longitudinal axis of the plunger 166. The rear plunger segment 172 also defines a rear hole 176 that is likewise positioned generally transverse to the longitudinal axis of the plunger 166. Each hole 174, 176 desirably is generally located symmetrically in relation to the corresponding aperture 160, 162 of the inner propulsion shaft 54.

As understood from FIG. 3, the front end of the plunger 166 is captured within a slot of an actuating cam follower 178 which is slidably supported in a known manner in the front of the lower unit 28. The interconnection between the actuating cam follower 178 and the front end of the plunger 166 allows the plunger 166 to rotate with the inner propulsion shaft 54 relative to the actuating cam follower 178. The actuating cam follower 178 receives a crank portion 180 of an actuating cam 182 positioned at a lower end of an actuating rod 184. The actuating rod 184 is journaled for rotation in the lower unit 28 and extends upwardly to a transmission actuator mechanism (not shown). Rotation of the actuating rod 184 actuates the cam 182 which positively reciprocates the cam follower 178 and the plunger 166 so as to shift the clutches 164, 126 between a forward drive position in which the front and rear clutches 164, 126 engage the front and rear gears 88, 90, respectively, a position of nonengagement (i.e., the neutral position show in FIG. 3), and a reverse drive position in which the front clutch 164 engages the rear gear 90.

The transmission 36 also desirably includes the detent mechanism 170 which cooperates between the plunger 166 and the inner propulsion shaft 54 to retain the clutches 164, 126 in the neutral position and to provide a predetermined force to resist shifting for torsionally loading the shift rod 184. The torsional loading of the shift rod 184 permits snap engagement between the clutches 164, 126 and the gears 88, 90 in the forward and reverse drive positions. This mechanism is of the type described in U.S. Pat. No. 4,570,776, issued Feb. 18, 1986, and entitled "Detent Mechanism for Clutches", which is assigned to the assignee hereof. This patent provides full details of the detent mechanism, and also the clutch actuating mechanism thus far described, and it is hereby incorporated by reference. In view of the description of the detent mechanism incorporated by reference and the fact that the detent mechanism 170 forms no significant part of the present transmission 36, a further description of the detent mechanism 170 is believed unnecessary.

As seen in FIG. 3, the front clutch 164 generally has a spool-like shape and includes an axial bore which extends between an annular front end plate and an annular rear end plate. The bore is sized to receive the inner propulsion shaft 54. The annual end plates of the front clutch 164 are substantially coextensive in size with the annular engagement surfaces 100, 102 of the front and rear gears 88, 90, respectively. The annular end plates each support a plurality of clutching teeth 186, 188 which correspond in size and number with the teeth 98, 104 formed on the respective engagement surfaces 100,102 of the front and rear gears 88, 90.

A splined connection (generally referenced as reference numeral 190) couples the front clutch 164 to the inner propulsion shaft 54. Internal splines of the front clutch 164 mate and engage with external splines on the exterior surface of the drive shaft 54. The external splines on the drive shaft 54 are formed at the increased diameter section of the shaft 54. This splined connection 190 provides a driving connection between the front clutch 164 and the inner propulsion shaft 54, while permitting the front clutch 164 to slide over the inner propulsion shaft 54, as discussed below.

As understood from FIG. 3, the front clutch 164 also includes a hole that extends through the midsection of the clutch 164 in a direction generally transverse to the longitudinal axis of the clutch sleeve 164. The hole is sized to receive a pin 192 which, when passed through the front aperture 160 of the inner propulsion shaft 54 and through the front hole 174 of the plunger 166, interconnects the plunger 166 and the front clutch 164 with a portion of the inner propulsion shaft 54 interposed therebetween. The pin 192 also interconnects the first and second segments 168, 172 of the plunger 166 by passing through the correspondingly aligned holes in the segments 168, 172, which together define the front hole 174 of the plunger 166. The pin 192 may be held in place by a press-fit connection between the pin 192 and the front hole 174 of the plunger 166, or, as seen in FIG. 3, by a conventional coil spring contained within a groove about the midsection of the front clutch sleeve 164.

Figure 5:
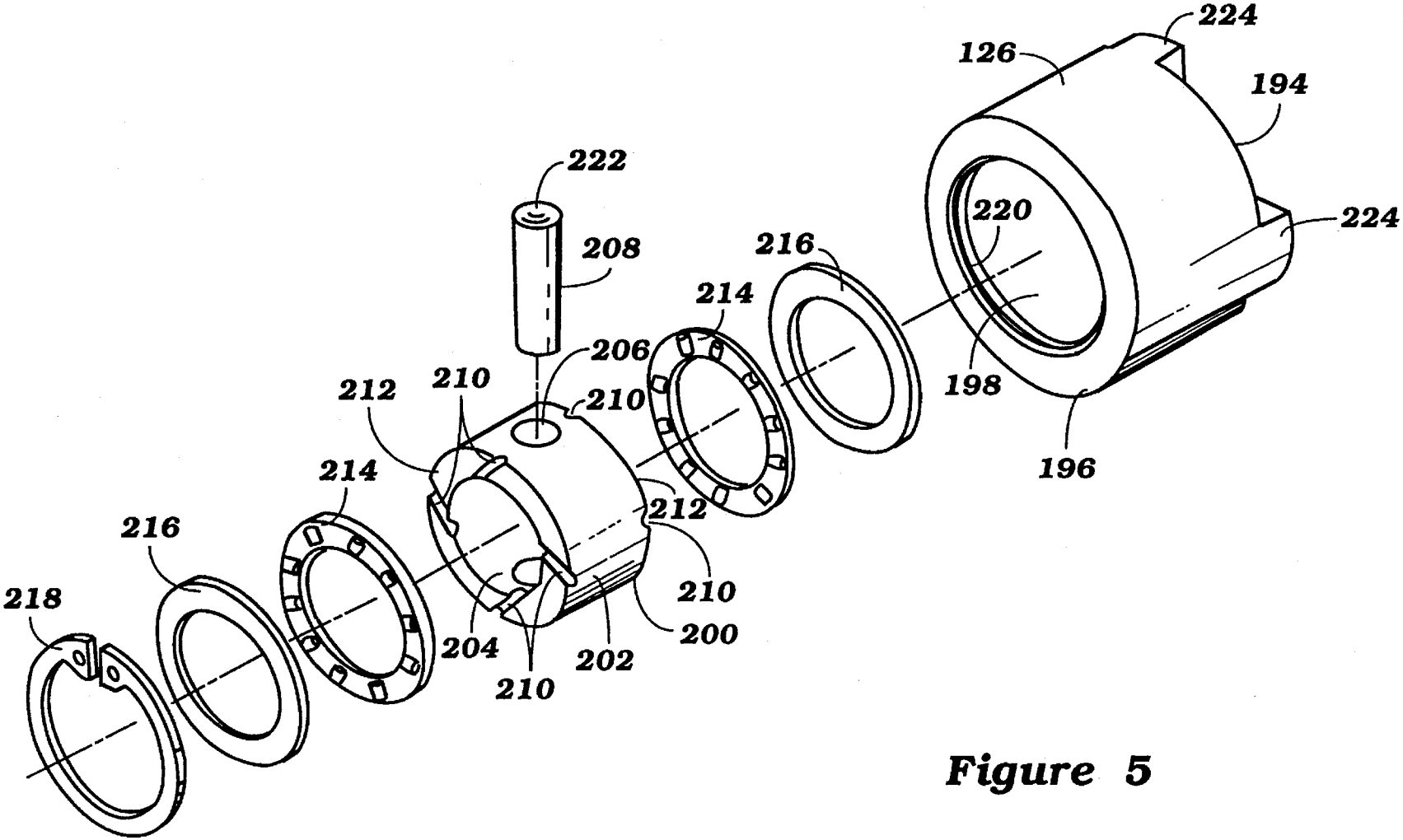
FIG. 5 is an exploded perspective view of a clutch coupling assembly of FIG. 4.

As best seen in FIGS. 4 and 5, the rear clutch 126 has a cylindrical sleeve shape sized to fit within the hollow front rim 142 of the outer propulsion shaft 74. As understood from FIG. 4, external splines extend from the cylindrical exterior surface of the rear clutch 126. (The external splines have been omitted from the clutch sleeve 126 shown in FIG. 5 to simplify the drawing.) The external splines mate with corresponding internal splines in the inner surface of the front rim 142 of the outer propulsion shaft 74 to establish a driving connection between the rear clutch 126 and the outer propulsion shaft 74, yet permit the clutch 126 to slide along an axis of the shaft 74 within the front rim 142 of the outer propulsion shaft 74.

The rear clutch 126 also includes an axial bore which extends between an annular front end plate 194 and a rear end 196. The bore is sized to receive the inner propulsion shaft 54.

As best understood from FIG. 4, the rear clutch 126 also includes a counterbore 198. The counterbore 198 is sized to receive a coupling mechanism. The coupling mechanism couples the rear clutch 126 to the plunger 166.

With reference to FIG. 5, the coupling mechanism in the illustrated embodiment includes an annular collar or bushing 200. The collar 200 has a tubular shape and fits loosely within the counterbore 198 of the rear clutch sleeve 126. That is, the diameter of an outer surface 202 of the collar 200 is smaller than the diameter of the counterbore 198. The diameter of an inner surface 204 of the collar 200 substantially matches the outer diameter of the inner propulsion shaft 54 on the rear side of the rear gear 90.

The annular collar 200 includes a transverse hole 206 which passes through the collar 200 at about its mid section. The hole 206 is sized to receive a pin 208.

The annular collar 200 also includes a plurality of angular slots 210 formed on end surfaces 212 of the collar 200. The slots 210 are skewed relative to a radius of the annular collar 200. The slots 210 form lubricant passages between the inner and outer surfaces 204, 208 of the collar 200.

The coupling mechanism also includes a pair of anti-friction members between which the collar 200 is interposed. In the illustrated embodiment, the coupling mechanism includes a pair of annular roller bearing assemblies 214 which are held against the end surfaces 212 of the annular collar 200 by a pair of washers 216. The roller bearings of the bearing assemblies 214 contact the end surfaces 212 of the annular collar 200 to journal the collar 200 for rotation about the axis of the inner propulsion shaft 54. Each roller bearing desirably rotates about an axis which lies along a radius of the annular collar 200. In this manner, the end surfaces 212 of the collar 200 can rotate relative to the bearing assemblies 214 without interference between the roller bearings of the bearing assemblies 214 and the angular slots 210 formed on the end surfaces 212 of the collar 200, which carry lubricant to the bearing assemblies 214.

Although the present embodiment illustrates the anti-friction members as annular roller bearing assemblies, it is understood that other types of anti-friction members can be used as well. For instance, the anti-friction members can be washers formed of an anti-friction material, such as, for example, Teflon® or Nylon, or can be other types of bearings or bushings.

A retainer ring 218 holds the annular collar 200, the bearing assemblies 214 and the support washers 216 within the counterbore 198 of the clutch sleeve 126. The retainer ring 218 snaps into an annular groove 220 formed on an inner wall of the counterbore 198 proximate to the rear end 196 of the clutch sleeve 126.

Figure 6:
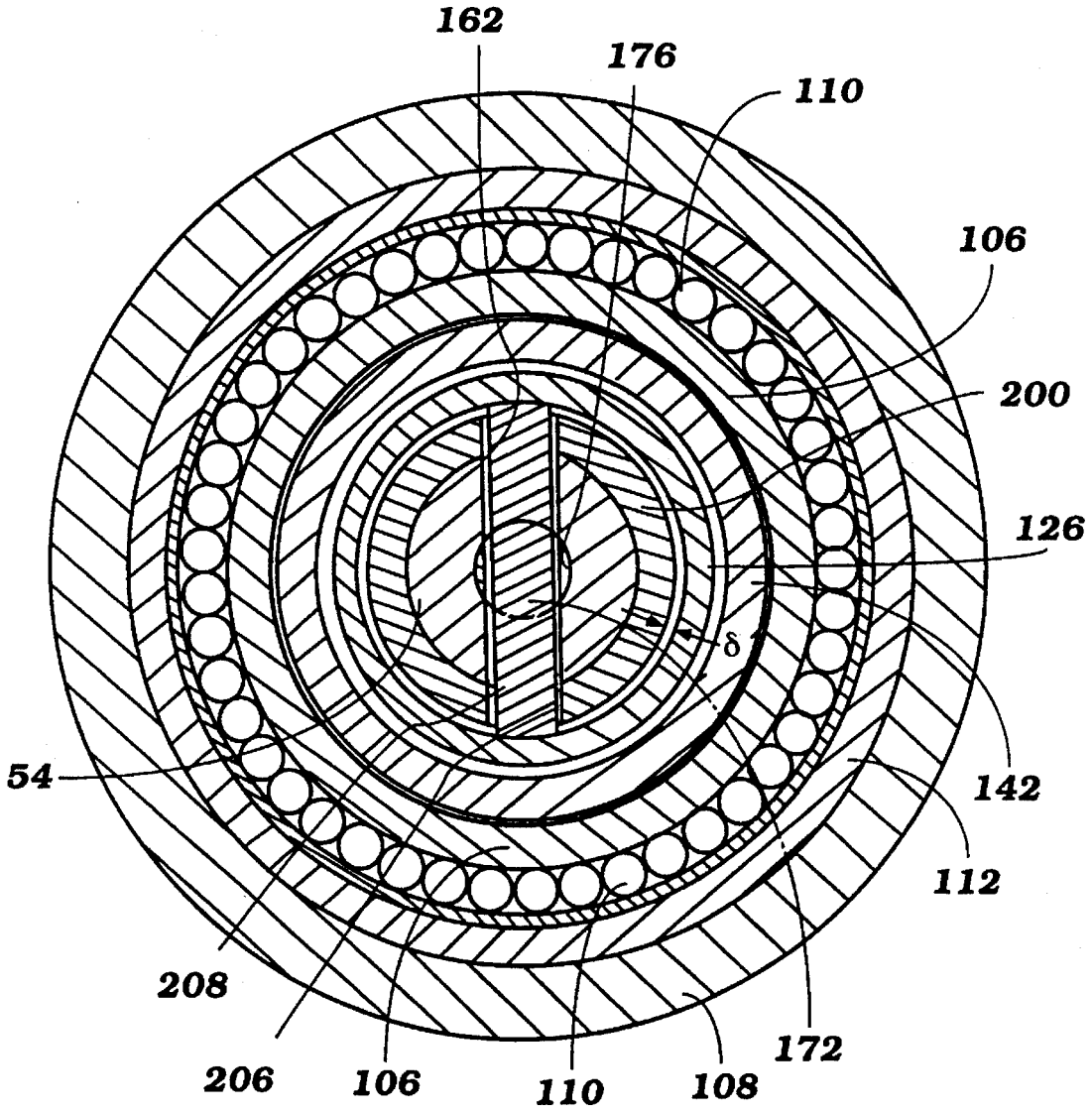
FIG. 6 is a cross-sectional view taken along the line A—A of FIG. 4.

As seen in FIGS. 4 and 6, the pin 208 has a length substantially equal to the diameter of the counterbore 198 of the clutch sleeve 126. The ends 222 of the pin (FIG. 5) desirably are rounded (i.e., hemispherical) to minimize frictional contact with the inner surface of the counterbore 198 of the clutch sleeve 126. When assembled, the annular collar 200 captures the ends 222 of the pin 208 which extend through the hole 206 in the annular collar 200. The pin 208 also extends through the rear aperture 176 of the plunger second segment 172 so as to couple the annular collar 200 and the clutch sleeve 126 to the plunger 166. In this manner, the annular collar 202 rotates with the plunger 166 and the inner propulsion shaft 54 within the counterbore 198 of the rear clutch sleeve 126. Axial movement of the plunger 166, however, moves the annular collar 200, which is captured within the counterbore 198 of the rear clutch sleeve 126, axially with respect to the outer propulsion shaft 74. The rear clutch 126 moves with the annular collar 200 in the axial direction sliding within the front rim 142 of the outer shaft 74.

A gap δ exists between the annular collar and the inner surface of the counterbore 198 of the rear sleeve 126. This gap insures that the annular collar 200 does not contact the inner surface of the rear clutch counterbore 198. Frictional contact between the components which rotate with the inner shaft 54 (i.e. the collar 200 and the pin 208) and the rear clutch 126, which rotates with the outer shaft 74, is thereby limited to the rounded end surfaces 122 of the pin 208. Because the collar 200 slips over the inner shaft 54 in a slip fit manner, the gap between the collar 200 and the inner wall of the rear clutch counterbore 198 is maintained. As understood from claim 4, the bearing assemblies 214 and support washers 216 lie within the rear clutch counterbore 198 with the pin 208 interposed between the pairings. The washers 216 rotate with the rear clutch sleeve 126 in an opposite direction to the annular collar 202 under at least one driving condition with the bearing assemblies journaling the adjacent surfaces of the washers 216 and the end surfaces 212 of the collar 200.

With reference to FIG. 4, the front annular end plate 194 of the rear clutch 126 is substantially coextensive in size with the rear annular engagement surface 124 of the rear gear 90. Teeth 224 extend from the front end plate 194 of the rear clutch 126 and desirably correspond to the teeth 128 of the rear gear 90 in size (e.g., axial length), in number and in configuration.

As understood from FIG. 4, the operation of the rear clutch 126 occurs within the front rim 142 of the outer shaft 74 and within the bearing hub 106 of the rear gear 90. That is, the movement of the clutch 126 from a position of nonengagement to a position of engagement occurs within the front rim 142 and within the bearing hub 106, and the driving connection between the rear clutch 126 and the outer propulsion shaft 74 also occurs within the front rim 142. The front rim 142 has a sufficient axial length to permit the rear clutch 126 to move from its forward engage position (in which the clutch teeth 224 engage the gear teeth 128) in the rearward direction by a sufficient travel to allow the front clutch 164 to engage the rear gear 90 without interference.

The operation of the present transmission 36 will now be described primarily in reference to FIGS. 3 and 4. FIG. 3 illustrates the front and rear clutches 164, 126 in a neutral position, i.e., in a position of nonengagement with the gears 88, 90. The detent mechanism 170 retains the plunger 166 and the coupled clutches 164, 126 in this neutral position.

To establish a forward drive condition, the actuator cam 182 moves the cam follower 178 and the plunger 166 forward, which in turn, slides the front and rear clutches 164, 126 forward over the inner propulsion shaft 54. The forward motion of the plunger 166 positively forces the front clutch 164 to engage the front gear 88 with the corresponding clutch teeth 98, 186 mating. The forward motion of the plunger 166 also positively forces the rear clutch 126 to engage the rear gear 90 with the corresponding clutching teeth 128, 224 mating.

So engaged, the front gear 88 drives the inner propulsion shaft 54 through the splined connection 190 between the clutch 164 and the inner propulsion shaft 54. The inner propulsion shaft 54 thus drives the rear propeller 42 (FIG. 2) in a first direction which asserts a forward thrust. As understood from FIG. 3, the rear gear 90 similarly drives the outer propulsion shaft 54 through the splined connection between the rear clutch 126 and the front rim 152 of the outer propulsion shaft 74. The outer propulsion shaft 74 thus drives the front propeller 40 (FIG. 2) to spin in an opposite direction to that of the rear propeller 42 and to assert a forward thrust.

To establish a reverse drive position, the actuator cam 182 moves the cam follower 178 and the plunger 166 in a rearward direction, which in turn, slides the front and rear clutches 164, 126 rearward over the inner propulsion shaft 54. The rearward motion of the plunger 166 positively forces the front clutch 164 to disengage from the front gear 88 and to engage the rear gear 90 with the corresponding clutching teeth 104, 188 mating. So engaged, the rear gear 90 drives the inner propulsion shaft 54 through the spline connection 190 between the clutch 164 and the inner propulsion shaft 54. The inner propulsion shaft 54 thus drives the rear propeller 42 (FIG. 2) in a direction which asserts a rearward thrust to propel the watercraft 14 (FIG. 1) in a reverse direction.

The rearward motion of the plunger 166 also moves the rear clutch 126 out of engagement with the rear gear 90. The corresponding clutching teeth 128, 224 disengage, as the outer shaft 74 is not driven under a reverse drive condition.

Figure 7:
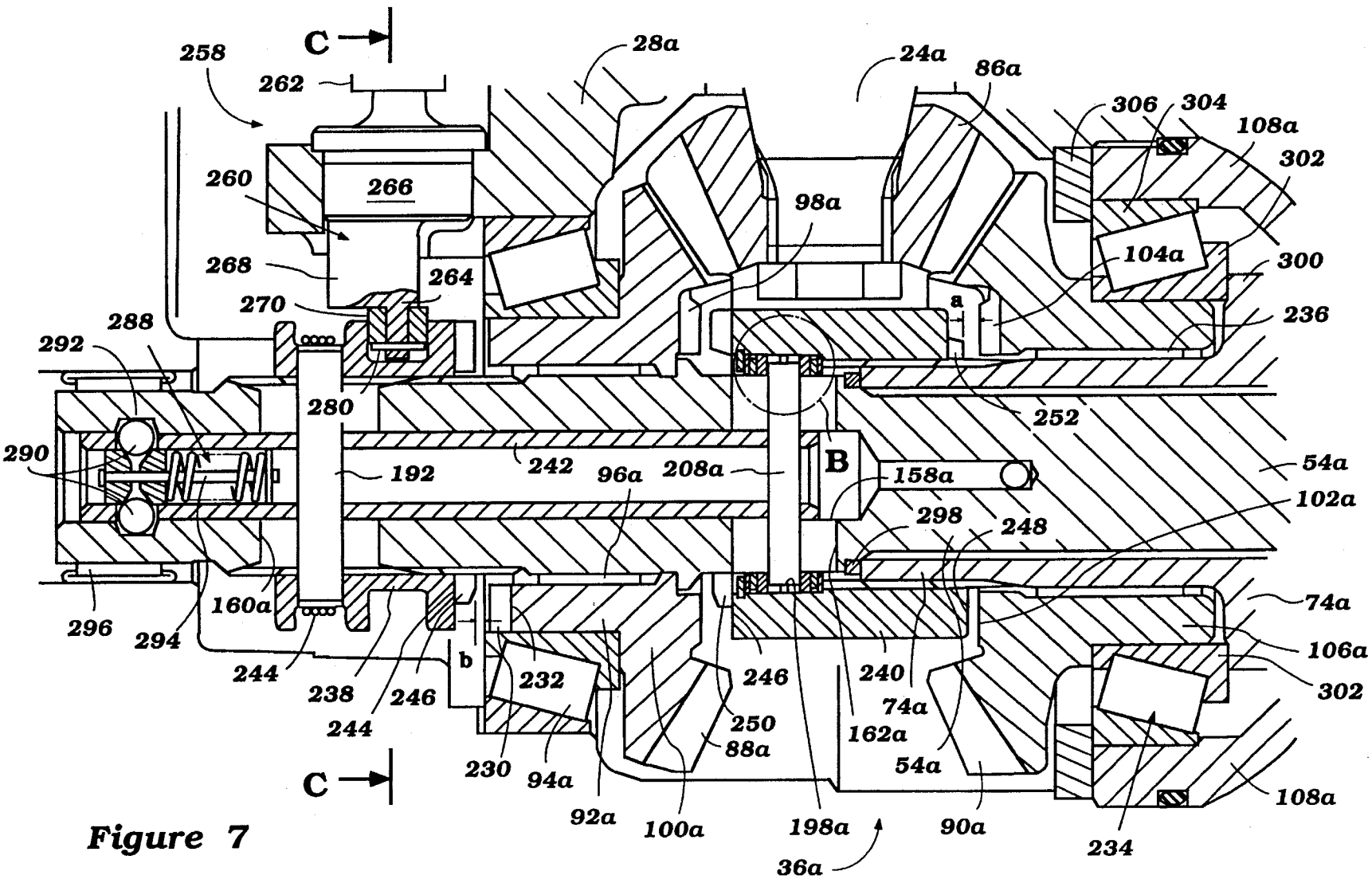
FIG. 7 is an enlarged side elevational view of a transmission in accordance with another preferred embodiment of the present invention.

FIG. 7 illustrates another preferred embodiment of the present transmission. Where appropriate, like numbers with an "a" suffix have been used to indicate like parts between the two embodiments for ease of understanding. Except for the transmission, the balance of the lower unit is substantially identical to that described above, and accordingly, the foregoing discussion of the lower unit should be understood as applying equally to the present embodiment, unless specified to the contrary.

With reference to FIG. 7, the drive shaft **24*a* carries a drive pinion 86*a* at its lower end, which is disposed within the lower unit 28*a* and which forms a portion of the transmission 36*a*. The drive pinion 86*a*** preferably is a bevel type gear.

The transmission **36*a* also includes a pair of counter rotating driven gears 88*a*, 90*a* that are in mesh engagement with the drive pinion 86*a*. The pair of driven gears 88*a*, 90*a* preferably are positioned on diametrically opposite sides of the drive pinion 86*a*, and are suitably journaled within the lower unit as described below. Each drive gear 88*a*, 90*a* is positioned at about a 90 degree shaft angle with the drive shaft 24*a*. That is, the propulsion shafts 54*a*, 74*a* and the drive shaft 24*a* desirably intersect at about a 90 degree shaft angle; however, it is contemplated that the drive shaft 24*a* and the propulsion shafts 54*a*, 74*a*** can intersect at almost any angle.

In the illustrated embodiment, the pair of driven gears are a front bevel gear **88*a* and an opposing rear bevel gear 90*a*. The front bevel gear includes a hub 92*a* which is journaled within a lower unit by a front thrust bearing 94*a*. The thrust bearing 94*a* rotatably supports the front gear 88*a* in mesh engagement with the drive pinion 86*a***.

As seen in FIG. 7, the bearing hub **92*a* has a central bore through which the inner propulsion shaft 54*a* passes when assembled. A bearing sleeve 96*a* journals the inner propulsion shaft 54*a* within the central bore of the front gear hub 92*a***.

The front gear **88*a* includes a series of teeth 230 on an annular front facing engagement surface 232, and includes a series of teeth 98*a* on an annular rear facing engagement surface 100*a*. The teeth 230, 98*a* on each surface 232, 100*a* positively engage a portion of a clutch of the transmission 36**, as discussed below.

The rear gear **90*a* also includes a hub 106*a* which is suitably journaled within a bearing carrier 108*a* of the lower unit 28*a* by a rear thrust bearing 234. The rear thrust bearing 234 rotatably supports the rear gear 90*a* in meshing engagement with the drive pinion 86*a***.

The hub 106*a* of the rear gear 90*a* has a central bore through which the inner propulsion shaft 54*a* and the outer propulsion shaft 74*a* pass when assembled. A bushing 236 journals the rear gear 90*a* on the outer shaft 74*a* when the outer shaft 74*a* passes through its central bore.

The rear gear 90*a* also includes an annular front engagement surface 102*a* which carries a series of teeth 104*a* for positive engagement with a clutch of the transmission 36, as discussed below.

As seen in FIG. 7, the driven gears 88*a*, 90*a* are journaled about the inner shaft 54*a* at positions generally symmetric to the axis of the drive shaft 24*a*. In this position, the rear gears 88*a*, 90*a* lie to the sides of a rear aperture 162*a* of the inner propulsion shaft 54*a*. The rear aperture 162*a* extends through the inner shaft 54*a*, transverse to the axis of the inner shaft 54*a*. The inner shaft 54*a* also includes a front aperture 160*a* which also extends transverse to the axis of the shaft 54*a* at a position forward of the front bevel gear 88*a*.

The front end of the inner propulsion shaft 54*a* includes a longitudinal bore 158*a*. The bore 158*a* stems from the front end of the inner shaft to a bottom surface which is positioned at the intersection between the axis of the drive shaft 24*a* and the axis of the inner shaft 54*a*.

FIG. 7 also illustrates a front clutch 238 and a rear clutch 240 of the present transmission 36*a*. In the illustrated embodiment, a plunger 242 inner connects the clutches 238, 240 for simultaneous operation. FIG. 7 illustrates the front and rear clutches 238, 240 in a neutral position (i.e., in a position in which the clutches 238, 240 do not engage either the front gear 88*a* or the rear gear 90*a*).

As discussed in detail below, the front clutch 238 selectively couples the inner propulsion shaft 54*a* to the front gear 88*a*. The rear clutch 240 selectively couples the outer propulsion shaft to either the front gear 88*a* or the rear gear 90*a*. In the illustrated embodiment, the clutches 238, 240 are positive-contact clutches, such as, for example, dog clutches; however, it is understood that the present transmission 36*a* can be designed with friction-type clutches.

The front clutch 238 is arranged in front of the front gear 88*a* on the inner shaft 54*a*. The front clutch 238 has a generally spool-like shape and includes an axial bore which extends between an annular front end and a flat annular rear engagement end 244. The rear engagement end 244 of the clutch 238 extends generally transverse to the longitudinal axis of the clutch 238. The bore is sized to receive the inner propulsion shaft 54*a*.

The rear engagement end 244 of the front clutch 238 is substantially coextensive in area which the front engagement surface 232 of the front gear 88*a*. Teeth 246 extend from the clutch rear surface 244 in the longitudinal direction, and desirably correspond to the teeth 230 of the front engagement surface 232 of the front gear 88*a*, in size (e.g., axial length), in number and in configuration.

FIG. 7 illustrates the front clutch 238 set in a neutral position (i.e., in a position in which the clutch 238 does not engage the front gear 88*a*). The teeth 246 of clutch 238, in this neutral position, are spaced from the front gear teeth 230 by a distance b, the importance of which is discussed below.

A spline connection couples the front clutch 238 to the inner propulsion shaft 54*a*. Internal splines on the front clutch 238 mate and engage with external splines on the exterior surface of the inner propulsion shaft 54*a* at its front end. This spline connection provides a driving connection between the front clutch 238 and the inner propulsion shaft 54*a*, yet permits the front clutch 238 to slide over the inner propulsion shaft 54*a*, as discussed below.

The front clutch 238 also includes a hole that extends through the mid section of the clutch 238 in a direction generally transverse to longitudinal axis of the clutch 238. The hole is sized to receive a pin 192*a*, which, when passed through the front aperture 160*a* and through a front hole in the plunger 242, inner connects the plunger 242 and the front clutch 238, with a portion of the inner shaft 54*a* interposed therebetween. The pin 192*a* may be held in place by a conventional coil spring 244 contained within a groove about the front clutch 238.

The rear clutch 240 generally has a tubular sleeve shape and includes an axial bore that extends between a flat annular front surface 246 and a flat annular rear surface 248. The bore is sized to receive the inner propulsion shaft 54*a* and a portion of the outer propulsion shaft's front end.

The annular end plates 246, 248 of the rear clutch 240 are substantially coextensive in size with the annular engagement surfaces 100*a*, 102*a* of the front and rear gears 88*a*, 90*a*, respectively. Teeth 250, 252 extend from each surface 246, 248, respectively. The teeth 250, 252 desirably correspond to the respective teeth 98*a*, 104*a* of the front and rear gears 88*a*, 90*a*, in size (e.g., axial length), in number and in configuration.

FIG. 7 illustrates the rear clutch 240 set in a neutral position (i.e., in a position in which the clutch 240 does not engage either the front gear 88*a* or the rear gear 90*a*). The clutch 248 in this neutral position is spaced from the rear gear by a distance a. The distance a is advantageously larger than the distance b by which the front clutch 238 is spaced from the front gear 88*a*.

This nonuniform (i.e., unequal) spatial relationship between the front gear 88*a* and the front clutch 238 and the rear gear 90*a* and the rear clutch 240 causes the front clutch 238 to engage the front gear 88*a* before the rear clutch 240 engages the rear gear 90*a*. A staggered engagement decreases the shock on the transmission and clutch assembly, and permits quicker engagement between the gears 88*a*, 90*a* and the clutches 238, 240, because manual, simultaneous engagement of the clutches 238, 240 and gears 88*a*, 90*a* is not required.

As seen in FIG. 7, the corresponding teeth 230, 246 of the front gear 88*a* and the front clutch 238 have a longer axial length than the corresponding teeth 204*a*, 252 of the rear gear 90*a* and rear clutch 240. This permits the front clutch 238 to slide toward the front gear 88*a* when the corresponding teeth 230, 238 are already partially engaged, so as to permit the rear clutch 240 to slide into engagement with the rear gear 90*a*.

A splined connection connects the rear clutch 240 to the front end of the outer propulsion shaft 74*a*. This spline connection establishes a drive coupling between the rear clutch 240 and the outer shaft 74*a*, yet permits the clutch 240 to slide along the axis of the outer shaft 74*a* between the front and rear gears 88*a*, 90*a*. The rear clutch 240 specifically includes internal splines within the bore that mate with corresponding external splines on the outer periphery of the front end of the outer propulsion shaft 74*a*.

The rear clutch 240 also includes a counterbore 198*a*. The counterbore 198*a* is sized to receive a coupling mechanism. The coupling mechanism couples the rear clutch 240 to the plunger 242.

The coupling mechanism in the illustrated embodiment includes an annular collar or bushing 200*a*. The collar 200*a* has a tubular shape and fits loosely within a counterbore 198*a* of the rear clutch sleeve 240. That is, the diameter of the outer surface of the collar 200*a* is small than the diameter of the counterbore 198*a*. The collar 200 also has an inner diameter which, as understood from FIG. 8, is slightly larger than the diameter of the inner propulsion shaft by an amount B.

The annular collar 200*a* also includes a transverse hole 206*a* which extends through the collar 200*a* at about its mid section. The hole 206*a* is sized to receive a pin 208*a*. The annular collar also includes an annular groove 254 which circumscribes the annular collar at its mid section. As seen in FIG. 8, the hole 206*a* generally lies symmetrical relative to the annular groove 254.

The annular collar further includes a plurality of angular slots 210*a* formed on its end surfaces 212*a*. The slots 210*a* are skewed relative to the radius of the annular collar 200*a*. The slots 210*a* form lubricant passages between the inner and outer surfaces of the collar 200*a*.

Figure 8:
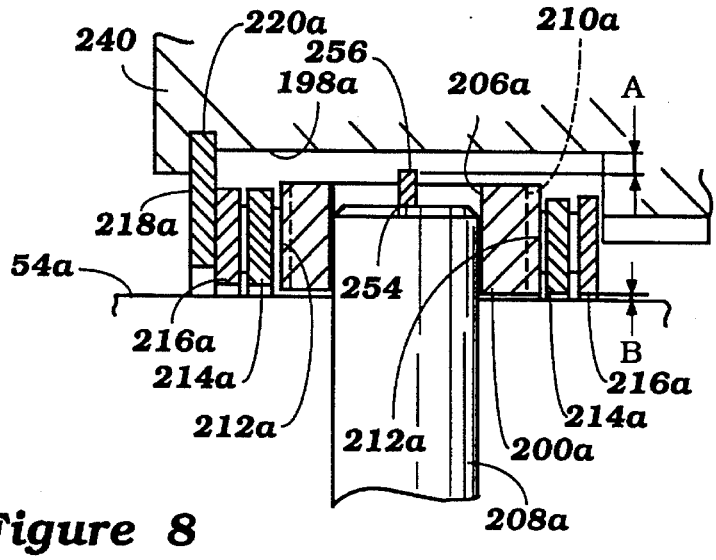
FIG. 8 is an enlarged side elevational view of the area within circle B of FIG. 7.

As best understood in FIG. 8, the coupling mechanism also includes a pair of anti-friction members between which the collar 200 is interposed. In the illustrated embodiment, the coupling mechanism includes a pair of annular roller bearing assemblies 214*a* which are held against the annular collar by a pair of washers 216*a*. The roller bearings of the bearing assemblies 214*a* contact the end surfaces 212*a* of the annular collar 200*a* to journal the collar 200*a* for rotation about the axis of the inner propulsion shaft 54*a*. Each roller bearing of the bearing assembly 214*a* desirably rotates about an axis which lies along a radius of the annular collar 200*a*. In this manner, the end surfaces 212*a* of the collar 200*a* can rotate relative to the bearing assemblies 214*a* without interference between the roller bearings of the assemblies 214*a* and the angular slots 210*a*, which carry lubricant to the bearing assemblies 214*a*.

As with the previous embodiment, although the present embodiment illustrates the anti-friction members as annular roller bearing assemblies, it is understood that other types of anti-friction members can be used as well. For instance, the anti-friction members can be washers formed of an anti-friction material, such as, for example, Teflon® or Nylon, or can be other types of bearings or bushings.

A retainer ring 218*a* holds the annular collar 200*a*, the bearing assemblies 214*a*, and the support washers 216*a* within the counterbore 198*a* of the clutch sleeve 240. The retainer ring 218*a* snaps into an annular groove 220*a* formed on an inner wall of the counterbore 198*a* proximate to the front engagement surface 246 of the rear clutch 240.

As seen in FIG. 8, the pin 208*a* has a length less than the outer diameter of the annular bushing 200*a*, and desirably has a length equal to the distance between the bottom of the annular groove 254 measured across the annular bushing 200*a*. When assembled, the pin 208*a* extends through the transverse hole 206*a* of the annular bushing 200*a*, and passes through the rear aperture 126*a* of the inner propulsion shaft 54*a* and through a rear hole of the plunger 242*a*. In this manner, the annular collar 200*a* rotates with the plunger 242 and the inner propulsion shaft 54*a* within the counterbore 198*a* of the rear clutch sleeve 242. Axial movement of the plunger 242, however, moves the annular collar 200*a*, which is captured within the counterbore 198*a* of the rear clutch sleeve 242, axially with respect to the outer propulsion shaft 74*a*. The rear clutch 240 moves with the annular collar 200*a* in the axial direction sliding over the front end of the outer shaft 74*a*.

A ring clip 256 holds the pin 208*a* within the annular collar 200*a*. The clip 256 is positioned within the annular groove 254 about the exterior of the collar 200*a*. As seen in FIG. 8, the ring clip 256, when contained within the annular groove 254 on the collar 200*a* is spaced from the inner wall of the counterbore 198*a* by a distance A. In order to prevent contact between the annular collar 200*a* and the clutch sleeve 240, which rotate in opposite direction during at least one drive condition, the distance a between the retainer ring 256 and the inner wall of the counterbore 198*a* is greater than the distance B between the collar 200*a* and the inner shaft 54*a*. The collar 200*a* cannot shift off the axis of the inner propulsion shaft 54*a* by more than the amount B, and because the distance B is less than the distance A, the retainer ring 256 cannot contact the inner wall of the rear clutch counterbore 198*a*. That is, although the collar 200*a* can float or shift relative to the axis of the inner shaft 54*a*, it is prevented from contacting the inner wall of the rear clutch counterbore 198*a*.

With reference to FIG. 7, the plunger 242 interconnects the front and rear clutches 238, 240, as noted above. The plunger 242 has a generally cylindrical rod shape and slides within the longitudinal bore 158*a* of the inner propulsion shaft 54*a* to actuate the clutches 238, 240. The plunger 242 may be solid. However, it is preferred that the plunger 242 be hollow (i.e., have a cylindrical tube shape), especially where a conventional neural detent mechanism of the type described below is used.

An actuator mechanism 258 moves the plunger 242 from a position in which the front and rear clutches 238, 240 engage the front and rear gears 88*a*, 90*a*, respectively, through a position of nonengagement (i.e., a neutral position), and to a position in which the rear clutch 240 engages the front gear 88*a*. The actuator mechanism 258 positively reciprocates the plunger 242 between these positions.

The actuator mechanism 258 includes a cam member 260 that connects the plunger 242 to a rotatable shift rod 260. In the illustrated embodiment, the shift rod 262 is journaled for rotation in the lower unit 28*a* and extends upwardly to a transmission actuator mechanism (not shown). The actuator mechanism 258 converts rotational movement of the shift rod 262 into linear movement of the plunger 242 to move the plunger 242 and the clutches 238, 240 generally along the axis of the propulsion shafts 54*a*, 74*a*.

Figure 9:
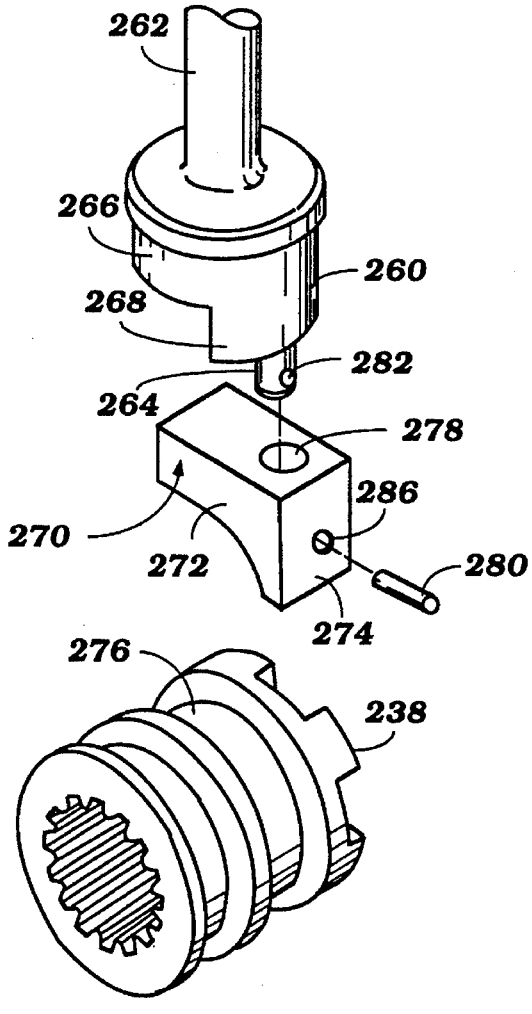
FIG. 9 is cross-sectional view taken along line C—C of FIG. 7.

As best seen in FIG. 9, the cam member 260 is affixed to the lower end of the shift rod 262. The cam member 260 includes an eccentrically positioned drive pin 264 which extends downwardly from the cam member 260. The cam member 260 also includes a cylindrical upper bearing 266 and a smaller lower member 268. The upper bearing 266 is positioned to rotate about the axis of the shift rod 262, and, as seen in FIG. 7, is suitably journaled within an upper bore of the lower unit 28*a*. The lower member 268 is eccentrically positioned relative to the axis of the shift rod 262 and the upper bearing 266.

FIG. 9 also best illustrates a follower 270 of the actuator mechanism 258. The follower 270 has a generally rectangular block-like body 272 with a retention arm 274 depending from one end. The retention arm 274 advantageously depends from a leading edge of the body 272 relative to the designed rotation of the clutch 238. In the illustrated embodiment, the retention arm 274 depends from the right side of the body 272 where the clutch 238 is designed to rotate in the counter-clockwise direction. As best understood from FIG. 10, the retention arm 274 holds the follower 270 on the clutch 238 with the follower body 272 captured between the clutch 238 in a rear groove 276 and the lower end of the lower member 268 of the cam member 130.

Figure 10:
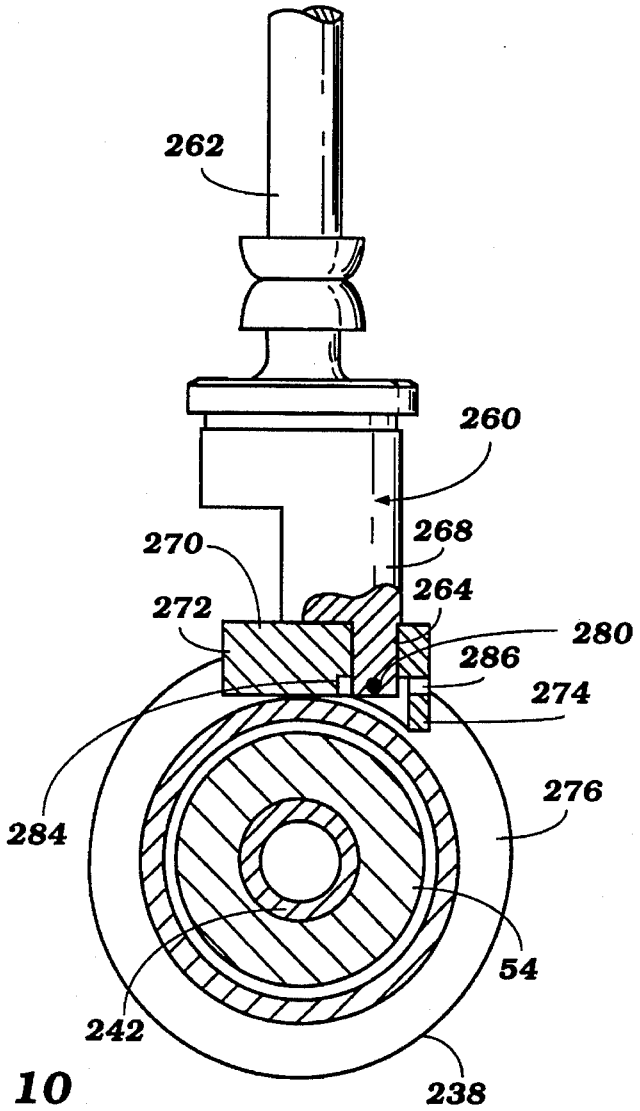
FIG. 10 is an exploded perspective view of an actuator and front clutch assembly of the transmission of FIG. 7.

The follower 270 also includes an aperture 278 which extends into the body 272 from the end from which the retention arm 274 depends, and, which, as best seen in FIG. 10, extends through the body 272 in a transverse direction. The aperture 278 has a width generally equal to the diameter of the drive pin 264 of the cam member 260. When assembled, as illustrated in FIG. 10, the drive pin 264 extends through the aperture 276.

A retention pin 280 holds the follower 270 on the end of the cam member 260 with the drive pin 264 extending through the aperture 278. As best understood from FIG. 9, the pin 280 extends through an aperture 282 formed in the drive pin 264 at its lower end. The pin retention 280 has a length slightly longer than the diameter of the drive pin 264, and as understood from FIG. 10, is sized to rotate within a lower aperture 284 formed on the lower surface of the follower body 272 proximate to the retention arm 274.

As seen in FIGS. 9 and 10, the retention arm 274 includes a hole 286 which is sized to receive the retention pin 280. The retention arm 274 allows the retention pin 280 to be inserted into the aperture 282 on the lower end of the drive pin 264 with the follower 270 positioned within the rear groove 276. When fully assembled, the retention pin 280 lies within the lower aperture 284 of the follower body 272 and does not cooperate with the aperture 286 in the retention arm 274. A press fit connection desirably holds the retention pin 280 in the lower aperture 282 of the drive pin 264.

As best understood from FIG. 9, the follower body 272 has a width which generally equals the width of the rear annular groove 276 on the exterior of the front clutch 238. And, as best seen in FIG. 10, the follower body 272 has a height which generally matches the depth of the rear annular groove 272 of the front clutch 238. In this manner, the clutch groove 272 receives and captures the follower 270 of the actuated mechanism 158.

The drive pin 264 moves both axially and transversely with rotation of the cam member 260 because of the eccentric position of the drive pin 264 relative to the rotational axis of the cam member 260. The axial travel of the drive pin 264 causes the follower 270 and the coupled clutch 238 to move axially, sliding over the inner propulsion shaft **54*a*. The rotational travel of the drive pin 264 causes the follower 270 to slide in and out of the annular groove 276 of the front clutch 238. As seen in FIG. 10, a sufficient gap exists between the bottom of the annular groove 276 and the follower body 272 and retention arm 274. The gap allows the follower to move into the annular groove from the neutral position shown in FIG. 10 as the front clutch 238** is moved from its neutral position to either forward or reverse drive position.

With reference to FIG. 7, the front clutch 238 is coupled to the cam member 260 with the follower 270 cradled between the walls of the rear annular groove 270 on the front clutch 238. The actuator mechanism 258 configured accordingly positively moves the front clutch 238 along the axis of the inner propulsion shaft **54*a* with rotational movement of the cam member 260 operated by the shift rod 262. The coupling between the actuator mechanism 158 and front clutch 238, however, allows the clutch 238 to rotate with the inner propulsion shaft 54*a* relative to the follower 270 and the cam member 260**.

The present transmission **36*a* and actuator mechanism 258 additional may include a neutral detent mechanism 288 for releasably retaining the plunger 242 (and the coupled clutches 238, 240) in the neutral position. FIG. 7 illustrates an embodiment of a neutral detent mechanism 288 used with the hollow plunger 242. The detent mechanism 288 operates between the plunger 242 and the inner bore 258*a* of the propulsion shaft 54*a***, as described below.

The neutral detent mechanism 288 is formed in part by at least one, and preferably at least two, transversely positioned holes in the plunger 242. These holes receive detent balls 290. The detent balls 290 each have a diameter slightly smaller than the diameter of each transverse hole in the plunger 242.

As seen in FIG. 7, the inner propulsion shaft **54*a* includes an annular groove 292 which is formed on the inner wall of the bore 158*a* through which the plunger 242 slides. The groove 292 is positioned within the bore 158*a* so as to properly locate the clutches 238, 240 in the neutral position when the detent balls 292 of the plunger 242 coincide with the axial position of the annular groove 292**.

A spring plunger 294, formed in part by helical compression spring, biases the detent balls 290 radially outward, against the inner wall of the inner propulsion shaft bore **158*a*. The plunger 242 contains the spring plunger 294 within its bore. The spring plunger 294 forces the detent balls 290 into the annular groove 292 when the plunger 242 is moved into the neutral position. This releasable connection between the detent balls 290 carried by the plunger 242 and the groove 294 of the inner propulsion shaft 54*a* releasably retains movement of the plunger 242 relative to the inner propulsion shaft 54*a*, as known in the art. Because the detent mechanism 288 is believed to be conventional, further description of the detent mechanism 288** is thought unnecessary for an understanding of the present invention.

The inner and outer propulsion shafts **54*a*, 74*a*, extend from the transmission 36*a* to the propulsion device 38*a* (FIG. 1) to drive the propulsion device 38*a* when selectively driven by the transmission 36*a*. In the illustrated embodiment, a front end of the propulsion shaft 54*a* is supported within the lower unit 28*a* in front of the front clutch 238. A front needle bearing assembly 296 journals the front end of the inner propulsion shaft 54*a* in this position. The inner propulsion shaft, as noted above, extends through the front gear hub 92*a* and the rear gear hub 106*a*. On the rear side of the front gear 238, the inner shaft 54*a* extends through the outer shaft 74*a*** and is suitably journaled therein.

The outer shaft **74*a* includes a narrowed front end which supports the external splines that engage the rear clutch 240. The front end of the outer shaft 74*a* lies within a step formed on the inner shaft 54*a*. An anti-friction washer or thrust bearing 298 sits within the step to minimize friction between the counter rotating shafts 54*a*, 74*a***.

The outer shaft **74*a* includes a thrust flange 300 formed behind the front end of the outer shaft 74*a* and positioned to engage a cone 302 of the rear thrust bearing assembly 234. The thrust flange 300 loads the cone 302 of the bearing assembly 234 in an opposite direction to the force loading applied by the rear gear 90*a*. This thrust bearing arrangement reduces the thrust loading on the rear thrust bearing assembly 234 as the opposing loads cancel each other to some degree. The resultant forward thrust loading produced under a forward drive condition is transferred to a cup 304 of the bearing assembly 234 and then to a shim ring 306 fixed within the lower unit 28*a* between the lower unit 28*a* and the front end of the bearing carrier 108*a***.

The following elaborates on the previous description of the operation of the present transmission **36*a*. FIG. 3 illustrates the front and rear clutches 238, 240 in a neutral position, i.e., a position of non-engagement with the gears 88*a*, 90*a*. The detent mechanism 288 retains the plunger 242 and the coupled clutches 238, 240** in this neutral position.

To establish a forward drive condition, the shift rod 262 rotates the cam member 260 in a manner which moves the drive pin 264 axially in the reverse direction. In the illustrated embodiment, counterclockwise rotation of the shift rod 264 moves the eccentric driving pin 264 axially in that direction. The follower 270 thus follows the drive pin 264 to slide the front clutch 238 over the inner propulsion shaft 54*a*. The actuator mechanism 258 thereby forces the front clutch 238 into engagement with the front gear 88*a*, with the corresponding clutch teeth 246, 230 mating. So engaged, the front gear 88*a* drives the inner propulsion shaft 54*a* through the internal spline connection between the clutch 238 and the inner propulsion shaft 54*a*. The inner propulsion shaft 54*a* in turn drives the rear propeller 42 (FIG. 1) in a first direction which asserts a forward thrust.

Further forward motion of the clutch 238 causes the plunger 242 to slide within the longitudinal bore 158*a* of the inner propulsion shaft 54*a* in the reverse direction due to the direct coupling by the pin 192*a*. The plunger 242 moves the rear pin 208*a* in the rearward direction to force the rear clutch 240 to engage the rear gear 90*a* with a corresponding clutching teeth 252, 104*a* mating. So engaged, the rear gear 90*a* drives the outer propulsion shaft 54*a* through the spline connection between the rear clutch 240 and the outer propulsion shaft 74*a*. The outer propulsion shaft 74*a* drives the front propeller 40 (FIG. 1) to spin in an opposite direction to that of the rear propeller 42, and to assert a forward thrust.

As mentioned above, the front clutch engages the front gear 88*a* before the rear clutch 240 engages the rear gear 90*a*. The length of the teeth 246, 230 of the front clutch 238 and front gear 88*a* permits the further meshing between the teeth 246, 230 of the front clutch 238 and front gear 88*a* so that the rear clutch 240 can engage the rear gear 90*a*.

Although mechanical shock occurs when the rear clutch 240 engages the rear gear 90*a*, the shock is reduced compared to prior shifting mechanism because the front clutch 238 has already engaged the front gear 88*a*. Thus, by staggering the engagement of the clutches 238, 240, the associated mechanical shock is separated, reducing the amount of shock experienced by the transmission 36*a* at one time.

In addition, the staggered engagement process quickens the engagement. Because synchronization of both the teeth of the front gear 88*a* and the front clutch 238, and the teeth of the rear gear 90*a* and the rear clutch 240 is not required. With prior shifting mechanisms, the engagement of the clutches requires synchronized registration of the front clutch/gear pairing and the rear clutch/gear paring because engagement occurs simultaneously. Only when both the teeth of the front gear and clutch and the rear gear and clutch are in phase will clutch engagement occur.

To establish a reverse drive condition, the shift rod 262 rotates in an opposite direction so as to move the cam member 260 and the eccentrically positioned drive pin 264 in a direction. In response, the drive pin 264 moves axially in the forward direction. Again, in the illustrated embodiment, clockwise rotation of the shift rod 262 eccentrically rotates the drive pin 264 so as to move the drive pin axially in the forward direction. The forward movement of the drive pin 134 is transferred to the plunger 242 through the follower 270, the clutch 238, and the pin 192*a*. The forward motion of the plunger 242 positively forces the rear clutch 240 into engagement with the front gear 88*a* with the corresponding clutching teeth 250, 98*a* mating. So engaged, the front gear 88*a* drives the outer propulsion shaft 74*a* through the spline connection between the rear clutch 240 and the outer propulsion shaft 74*a*. The outer propulsion shaft 74*a* thus drives the front propeller 40 (FIG. 1) in a direction which asserts a reverse thrust to propel the watercraft 14 (FIG. 1) in reverse.

Figure 11:
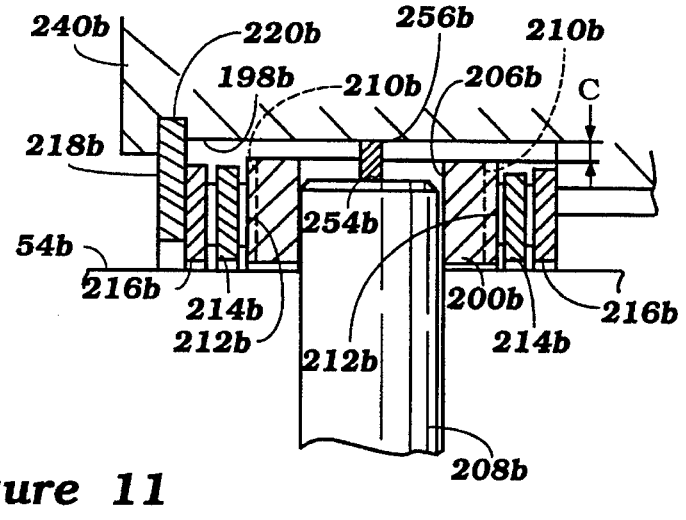
FIG. 11 is an enlarged sectional side elevational view of a rear clutch coupling assembly in accordance with an additional preference embodiment of the present invention.

FIG. 11 illustrates an additional embodiment of the clutch coupling mechanism used to couple the rear clutch to the actuating plunger. The clutch coupling mechanism illustrated in FIG. 11 is substantially identical to that illustrated in FIGS. 7 and 8. Where appropriate, like reference numerals with a "b" suffix have been used to illustrate like components between these embodiment.

With reference to FIG. 11, the retainer ring 256*b* used to hold the pin 208*b* within the annular bushing 200*b* lies within the annular groove 254*b* that circumscribes the bushing 200*b*. The retainer ring 256*b* has an outer diameter which substantially matches the inner diameter of the counterbore 198*b*.

The retainer ring 256*b* also has a thickness as thin as possible, in order to minimize the contact area with the inner surface of the counterbore 198*b*. The thickness of the retainer ring 256*b* desirably is less than one-half the diameter of the pin 208*b*. In the illustrated embodiment, the retainer ring 256*b* has a thickness generally equal to about one-tenth the thickness of the pin 208*b*.

The retainer ring 256*b* desirably is formed of a anti-friction material, and more preferably a self lubricating material, such as for example, Teflon™. The anti-friction material of the retainer ring 256*b* further reduces friction between the retainer ring 256*b* and the inner surface of the rear clutch counterbore 198*b*.

When assembled as seen in FIG. 11, the annular collar 200*b* is spaced from the inner surface of the rear clutch counterbore 198*b* by a distance C. The retainer ring 256*b* positioned between the inner surface of the counterbore 198*b* and the outer periphery of collar 200*b* maintains this spacing C. Thus, although the collar may loosely fit on the inner shaft 54*b*, it cannot contact the inner surface of the rear clutch counterbore 198*b*.

As common to all of the embodiments described above, the clutch actuator mechanism of the transmission includes a coupling mechanism formed in part by an annular member held within the clutch in a manner permitting relative rotation between the clutch and the annular member. The annular member also is connected to the actuator mechanism so as to move axially and/or rotate with the actuator mechanism. In this manner, the annular member, when moved by actuator in an axial direction, moves the clutch axially, while allowing the clutch to rotate relative to the annular member.

Sufficient spacing is maintained between the annular member and the clutch to prevent frictional contact between these two components. The ends of the annular member also are journaled within the clutch to form a direct coupling between the clutch and the annular member, while friction contact through this coupling is minimized when the clutch and annular member rotate in opposite directions.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A transmission for a marine outboard drive comprising a first driven gear and a corresponding first clutch coupled to a first propulsion shaft, said first clutch arranged to selectively couple said first propulsion shaft to said first driven gear when actuated by an actuator, said actuator connected to an annular member journaled within said first clutch in a manner permitting said first clutch to rotate relative to said annular member.

2. A transmission as in claim 1 wherein said clutch has an inner cavity in which said annular member is disposed, said inner cavity having a shape and size complimentary to the shape and size of said annular member.

3. A transmission as in claim 2, wherein said annular member has a disc-like shape.

4. A transmission as in claim 2 additionally comprising a second propulsion shaft which extends through said first clutch and through said annular member.

5. A transmission as in claim 4, wherein said annular member is adapted to rotate with said second propulsion shaft.

6. A transmission as in claim 4, wherein said annular member includes an inner hole of a diameter sized to allow said annular member to slide over said second propulsion shaft.

7. A transmission as in claim 6, wherein a clearance between said annular member and said second propulsion shaft is less than a clearance between said annular member and an inner wall of said inner cavity of said first clutch.

8. A transmission as in claim 6, wherein at least one pin connects said annular member to said actuator, said pin extending in a transverse direction relative to an axis of said second propulsion shaft, at least one end of the pin being captured within said annular member.

9. A transmission as in claim 8, wherein a retainer ring at least partially lies within an annular groove which circumscribes said annular member and is positioned such that said retainer ring holds said pin within said annular member.

10. A transmission as in claim 9, wherein said retainer ring project beyond the outer periphery of said annular member, and a gap between said retainer ring and an inner wall of said inner cavity of said first clutch is larger than a clearance between said annular member and said second propulsion shaft.

11. A transmission as in claim 4, wherein said actuator is positioned within said second propulsion shaft.

12. A transmission as in claim 4 additionally including at least one pin which connects said annular member to said actuator, said pin extending in a transverse direction relative to an axis of said second propulsion shaft, at least one end of the pin being captured within said annular member.

13. A transmission as in claim 12, wherein at least one end of said pin has a rounded, generally hemispherical shape.

14. A transmission as in claim 13, wherein said pin is sized such that said pin end contacts said inner surface of said first clutch.

15. A transmission as in claim 14, wherein said annular member includes an inner hole of a diameter sized to allow said annular member to slide over said second propulsion shaft with a clearance between said annular member and said second propulsion shaft being less than a clearance between said annular member and an inner wall of said inner cavity of said first clutch.

16. A transmission as in claim 12, wherein a retainer ring at least partially lies within an annular groove which circumscribes said annular member and is positioned such that said retainer ring holds said pin within said annular member.

17. A transmission as in claim 16, wherein said retainer ring projects beyond the outer periphery of said annular member, said retainer ring having an outer periphery of a diameter substantially equal to a diameter of said inner cavity of said first clutch, said retainer ring having a thickness smaller than at least one half the diameter of said pin.

18. A transmission as in claim 1, wherein said first clutch lies within a rim of said first propulsion shaft.

19. A transmission as in claim 1, wherein said first clutch receives at least a portion of said first propulsion shaft within an axial bore.

20. A transmission as in claim 1 additionally comprising a pair of anti-friction members disposed on either side of said annular member so as to journal said annular member within said first clutch.

21. A transmission as in claim 20, wherein said anti-friction members each comprise an annular roller bearing assembly.

22. A transmission as in claim 20, wherein said anti-friction members each comprise an annular roller bearing assembly.

23. A transmission for a marine outboard drive comprising a first driven gear and a corresponding first clutch coupled to a first propulsion shaft, said first clutch arranged to selectively couple said first propulsion shaft to said first driven gear when actuated by an actuator, a coupling mechanism coupling said first clutch to said actuator in a manner permitting the first clutch to rotate relative to said actuator, said coupling mechanism including a pin which extends within said first clutch in a direction generally transverse to an axis of said first propulsion shaft, said pin being connected to said actuator, and a collar held within said first clutch, said collar capturing at least a portion of said pin such that said collar rotates with said actuator.

24. A transmission as in claim 23, wherein said first clutch lies within a rim of said first propulsion shaft.

25. A transmission as in claim 23, wherein said first clutch receives at least a portion of said first propulsion shaft within an axial bore.

26. A transmission as in claim 23, wherein said first clutch includes positive-contact clutching elements.

27. A transmission as in claim 23, additionally comprising a second propulsion shaft which extends through said first clutch and through said collar.

28. A transmission as in claim 27, wherein said annular collar includes an inner hole of a diameter sized to allow said annular collar to slide over said second propulsion shaft.

29. A transmission as in claim 28, wherein a clearance between said annular collar and said second propulsion shaft is less than a clearance between said annular collar and an inner wall of an inner cavity of said first clutch.

30. A transmission as in claim 29, wherein said pin has rounded, generally hemispherically shaped ends.

31. A transmission as in claim 30, wherein said pin is sized such that said pin ends contact said inner surface of said first clutch.

32. A transmission as in claim 29, wherein a retainer ring at least partially lies within an annular groove which circumscribes said annular collar and is positioned such that said retainer ring holds said pin within said annular collar.

33. A transmission as in claim 32, wherein said retainer ring projects beyond the outer periphery of said annular collar, and a gap between said retainer ring and said inner wall of said inner cavity of said first clutch is larger than a clearance between said annular collar and said second propulsion shaft.

34. A transmission as in claim 32, wherein said retainer ring projects beyond the outer periphery of said annular collar, said retainer ring having an outer periphery of a diameter substantially equal to a diameter of said inner cavity of said first clutch, said retainer ring having a thickness smaller than at least one half the diameter of said pin.

35. A transmission as in claim 27, wherein said actuator is positioned within said second propulsion shaft.

36. A transmission as in claim 23, additionally comprising a pair of anti-friction member disposed on either side of said annular collar so as to journal said annular member within said first clutch.

37. A transmission as in claim 36 additionally comprising a pair of washers disposed within an inner bore of the first clutch, said collar being arranged between said anti-friction members which are interposed between said washers.

38. A transmission as in claim 37, wherein a retainer ring holds said annular collar, said anti-friction members and said washers within said inner bore of said first clutch.

* * * * *